US007918682B2

(12) United States Patent
Hirai

(10) Patent No.: US 7,918,682 B2
(45) Date of Patent: Apr. 5, 2011

(54) CONNECTOR SYSTEM FOR A VEHICLE ANTENNA

(75) Inventor: Tomoharu Hirai, Kobe (JP)

(73) Assignee: Fujitsu Ten Limited, Kobe-shi (JP)

( * ) Notice: Subject to any disclaimer, the term of this patent is extended or adjusted under 35 U.S.C. 154(b) by 0 days.

(21) Appl. No.: 12/656,186

(22) Filed: Jan. 20, 2010

(65) Prior Publication Data

US 2010/0203770 A1 Aug. 12, 2010

(30) Foreign Application Priority Data

Feb. 9, 2009 (JP) ..... 2009-027653

(51) Int. Cl.
*H01R 13/64* (2006.01)

(52) U.S. Cl. ..... 439/374

(58) Field of Classification Search ..... 439/374, 439/342, 916, 929; 343/713, 715, 906
See application file for complete search history.

(56) References Cited

U.S. PATENT DOCUMENTS

| | | | | |
|---|---|---|---|---|
| 3,915,535 | A * | 10/1975 | O'Keefe et al. | 439/63 |
| 4,084,163 | A * | 4/1978 | Maynard | 343/715 |
| 5,293,177 | A * | 3/1994 | Sakurai et al. | 343/906 |
| 5,431,570 | A * | 7/1995 | Gibbs et al. | 439/39 |
| 5,624,266 | A * | 4/1997 | Gibbs et al. | 439/34 |
| 5,825,096 | A * | 10/1998 | Morimoto et al. | 307/9.1 |
| 5,842,873 | A * | 12/1998 | Gonzales | 439/63 |
| 6,296,492 | B1 * | 10/2001 | Fujimoto et al. | 439/63 |
| 6,325,652 | B1 | 12/2001 | Grant | |
| 6,469,678 | B1 * | 10/2002 | Pullen | 343/888 |
| 6,509,878 | B1 * | 1/2003 | Tornatta et al. | 343/715 |
| 6,709,290 | B2 * | 3/2004 | Yoshida | 439/585 |
| 6,791,501 | B2 * | 9/2004 | Maeda et al. | 343/715 |
| 6,853,340 | B2 * | 2/2005 | Wang | 343/715 |
| 7,059,882 | B2 | 6/2006 | Sugita et al. | |
| 7,080,997 | B2 * | 7/2006 | Matsuo | 439/188 |
| 7,156,678 | B2 | 1/2007 | Feldman et al. | |
| 7,215,291 | B2 * | 5/2007 | Nakano et al. | 343/715 |
| 7,229,295 | B2 | 6/2007 | Ice et al. | |
| 7,338,316 | B2 * | 3/2008 | Blickle | 439/546 |
| 7,372,415 | B2 * | 5/2008 | Chun | 343/713 |
| 7,390,207 | B2 * | 6/2008 | Noguchi et al. | 439/248 |
| 7,429,958 | B2 * | 9/2008 | Lindackers et al. | 343/713 |
| 7,442,057 | B2 | 10/2008 | Ko | |
| 7,492,319 | B2 * | 2/2009 | Lindackers et al. | 343/713 |

(Continued)

FOREIGN PATENT DOCUMENTS

JP A-6-20667 1/1994

(Continued)

*Primary Examiner* — T C Patel
*Assistant Examiner* — Vladimir Imas
(74) *Attorney, Agent, or Firm* — Oliff & Berridge, PLC

(57) ABSTRACT

A connector system for a vehicle antenna is a system by joining a fixed connector having legs connected to a terminal of the vehicle antenna, with a movable connector that is removably connected to the fixed connector and has a cable connected to a signal receiving apparatus. A first slide mechanism is located on the fixed connector, extended along a surface where the legs touch, and the second slide mechanism, able to be fitted in the slide mechanism on the fixed connector, is located on the movable connector. By sliding the first slide mechanism and the second slide mechanism to be fitted in each other, the movable connector can be joined to the fixed connector along the surface where the connector system is installed.

16 Claims, 19 Drawing Sheets

U.S. PATENT DOCUMENTS

| | | | | |
|---|---|---|---|---|
| 7,564,417 | B2 * | 7/2009 | Tengler et al. | 343/715 |
| 7,588,459 | B2 * | 9/2009 | Sugii et al. | 439/567 |
| 7,652,630 | B2 * | 1/2010 | Rosenberger et al. | 343/713 |
| 7,663,561 | B2 * | 2/2010 | Hisaeda | 343/713 |
| 2003/0049956 | A1 * | 3/2003 | Yoshida | 439/98 |
| 2003/0112191 | A1 * | 6/2003 | Maeda et al. | 343/715 |
| 2006/0046547 | A1 * | 3/2006 | Matsuo | 439/188 |
| 2006/0114161 | A1 * | 6/2006 | Yamaguchi | 343/713 |
| 2006/0170610 | A1 * | 8/2006 | Rabinovich et al. | 343/895 |
| 2006/0199415 | A1 * | 9/2006 | Noguchi et al. | 439/350 |
| 2007/0279302 | A1 * | 12/2007 | Byrne et al. | 343/713 |
| 2008/0007480 | A1 * | 1/2008 | Chun | 343/906 |
| 2008/0012776 | A1 * | 1/2008 | Blickle | 343/713 |
| 2008/0122708 | A1 * | 5/2008 | Lindackers et al. | 343/713 |
| 2008/0129620 | A1 * | 6/2008 | Zurowski et al. | 343/713 |
| 2008/0198077 | A1 * | 8/2008 | Duzdar et al. | 343/715 |
| 2008/0214046 | A1 * | 9/2008 | Sugii et al. | 439/567 |
| 2008/0252537 | A1 * | 10/2008 | Petros | 343/713 |
| 2008/0272969 | A1 * | 11/2008 | Tengler et al. | 343/715 |
| 2008/0303740 | A1 * | 12/2008 | Schipper et al. | 343/878 |
| 2009/0040121 | A1 * | 2/2009 | Rosenberger et al. | 343/713 |
| 2009/0195341 | A1 * | 8/2009 | Rokuka et al. | 336/65 |
| 2009/0305544 | A1 * | 12/2009 | Mizumura et al. | 439/345 |
| 2010/0009565 | A1 * | 1/2010 | Wang | 439/345 |
| 2010/0203770 | A1 * | 8/2010 | Hirai | 439/700 |

FOREIGN PATENT DOCUMENTS

| | | |
|---|---|---|
| JP | A-8-317259 | 11/1996 |
| JP | A-2008-60626 | 3/2008 |
| JP | A-2008-187414 | 8/2008 |

* cited by examiner

PRIOR ART

PRIOR ART

CONNECTOR SYSTEM FOR A VEHICLE ANTENNA

BACKGROUND OF THE INVENTION

1. Field of the Invention

The invention relates to a connector system for a vehicle antenna.

2. Description of the Background Art

A vehicle antenna is conventionally installed on a front or rear windshield that is a fixed window of a vehicle, such as a car, for receiving radio waves for radio or television broadcasting. Received signals received by the antenna are transmitted to a signal receiving apparatus for radio or television broadcasting over a cable such as a coaxial cable. Therein, a connector is used to connect the cable and the antenna on the fixed window. The connector is mounted on an inside surface of the fixed window.

For example, Japanese Patent No. JP2008-60626 A discloses a connector for connecting to an antenna on a rear windshield. Hereinafter, an example of a connector system for connecting to an antenna on a front windshield will be described. FIG. 10 shows positions of connectors 2 and 3 mounted on a front windshield 1 of a car. In FIG. 10, an antenna is not illustrated. For example, the connector 2 is for a television antenna and the connector 3 is for a radio antenna.

Referring to FIG. 1A to FIG. 1E, a conventional structure of a connector system is now explained. FIG. 1A shows a conventional connector 2 for connecting an antenna (not illustrated) installed on a glass plate 1 of a vehicle fixed window (i.e., a front windshield 1) to a coaxial cable (hereinafter referred to as a cable) 22 connecting to a signal receiving apparatus mounted in a vehicle. In this example, a leg 5 is soldered to an antenna terminal on the glass plate 1, and the leg 5 holds an electrode section 6. The electrode section 6 is a metal plate that is perpendicular to the glass plate 1. As shown in FIG. 1B, the connector 2 has, at a front end, an opening 2A for accommodating the electrode section 6, and the cable 22 is connected to a rear end of the connector 2. An amplifier circuit may be installed in the connector 2.

FIG. 1C shows the connector 2 connected to the electrode section 6 shown in FIG. 1A, and a conventional layout in which another connector 3 is aligned in a longitudinal line with the connector 2 on the glass plate 1. The conventional connector 2, as shown in FIG. 1A, is inserted into the electrode section 6 from a longitudinal direction. Therefore, there should be space, between the connector 2 and the connector 3, that allows for insertion of the connector 2. As a result, the connector 2 cannot be placed close to the connector 3, and this connector has a disadvantage of little layout flexibility.

Another example is a connector system 4, shown in FIG. 1D, including a connector (holder) 4B for connection, mounted on a glass plate 1 of the vehicle, having legs 7 connected to an antenna on the glass plate 1, and a connector 4A for extracting signals which can be joined with the connector for connection 4B perpendicularly to the glass plate 1. FIG. 1E shows the connector 4A for extracting signals joined with the connector 4B for connection. This type of connector system needs no space between connectors for insertion even when aligned in a longitudinal line.

However, as for the connector system 4 shown in FIGS. 1D and 1E, the connector 4B for connection on the inside surface (on the cabin side) of the glass plate 1 is pushed outwards when the connector 4A for extracting signals is joined to the connector 4B for connection. Therefore, outward force is applied on the glass plate 1. Generally, adhesive is applied on the outside surface of a windshield frame and a windshield glass plate is attached on the frame from outside of a vehicle. The outward force may cause partial separation of the windshield glass plate from the frame if a connector is joined before the windshield glass plate adheres firmly to the frame.

SUMMARY OF THE INVENTION

A connector system for a vehicle antenna includes a first connector that is electrically connectable to a terminal of the vehicle antenna and a second connector that is electrically connectable to a cable for transmittance of received signals received by the vehicle antenna to a signal receiving apparatus that uses the received signals, and the second connector is attachable to and removable from the first connector and is electrically connected to the first connector when attached to the first connector. The first connector includes legs for touching a mounting surface of the first connector so as to be electrically connected to the terminal of the vehicle antenna and a first slide mechanism extending substantially parallel to the mounting surface, and the second connector includes a second slide mechanism for sliding along an extending direction of the first slide mechanism and being mateable with the first slide mechanism.

The second connector can be slid along the mounting surface toward the first connector connected to a vehicle antenna. As a result, no force is applied on the mounting surface when the second connector is joined to the first connector, and this connector can prevent separation of the mounting surface from a vehicle frame.

According to another aspect of the invention, the first slide mechanism and the second slide mechanism slide in a direction perpendicular to a longer side direction of the first connector.

The sliding direction perpendicular to the longer side of the connector eliminates need for space for insertion between the connectors aligned in a longitudinal line.

Therefore, an object of the invention is to provide a technology in which no force is applied on a mounting surface when a removable first connector is joined with the second connector.

These and other objects, features, aspects and advantages of the invention will become more apparent from the following detailed description of the invention when taken in conjunction with the accompanying drawings.

BRIEF DESCRIPTION OF THE DRAWINGS

FIGS. 11A to 11I is joined when a longer side of the fixed connector illustrated in FIG. 12A is mounted to a vehicle front pillar;

FIGS. 11A to 11I is joined when the other longer side of the fixed connector illustrated in FIG. 12A is mounted to a vehicle front pillar;

DESCRIPTION OF THE EMBODIMENTS

Hereinbelow, embodiments of the invention related to a connector system for a vehicle antenna are described based on specific embodiments of a connector system for being mounted on a vehicle windshield glass plate.

1. First Embodiment

Figure 1A:
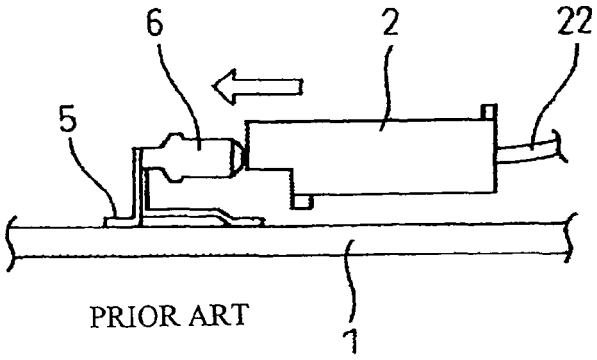
FIG. 1A is a side view showing a state where a female connector is connected to a conventional connecting terminal on an antenna installed on a vehicle glass window.
Figure 1B:
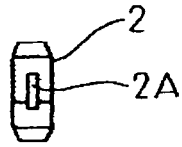
PRIOR ART FIG.1B
FIG. 1B is a front view of the female connector illustrated in FIG. 1A.
Figure 1C:
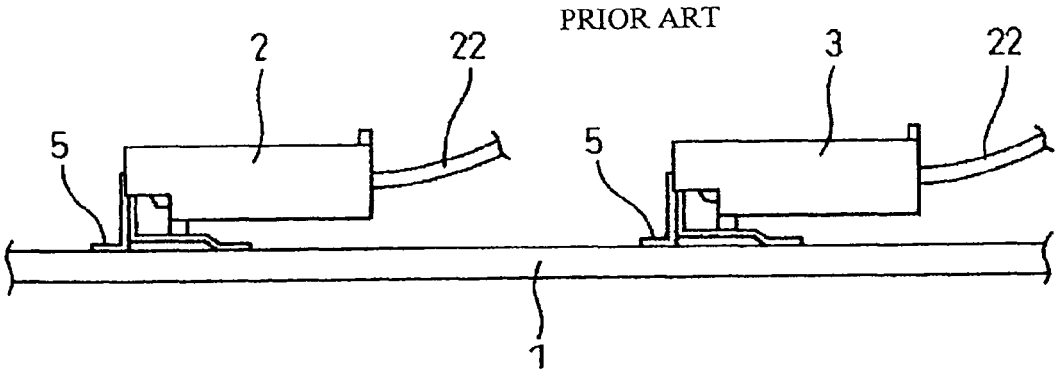
FIG.1C PRIOR ART
FIG. 1C shows a conventional connector layout with two antennas placed in a line on the vehicle glass window and the connecting terminals, illustrated in FIG. 1A, connected to connectors.
Figure 1D:
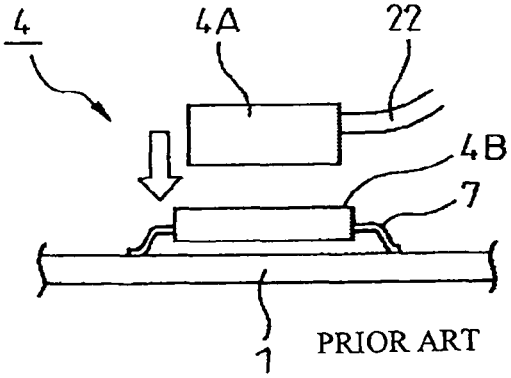
FIG. 1D shows an exemplary conventional connector system for a vehicle antenna in which a connector for connection, placed on an antenna on the vehicle glass window, is fitted in a connector for extracting signals.
Figure 1E:
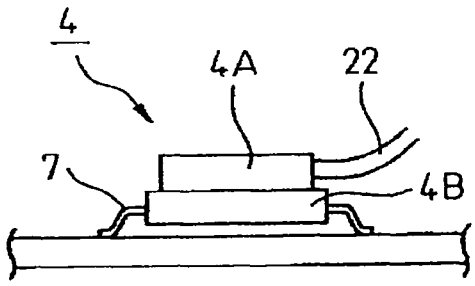
PRIOR ART FIG.1E
FIG. 1E shows a state where the connector for extracting signals, illustrated in FIG. 1D, is jointed with the connector for connection.
Figure 2A:
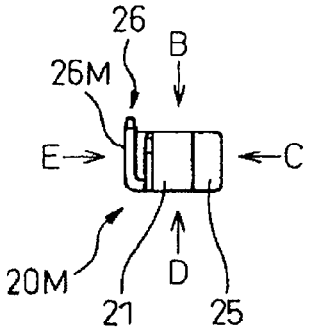
FIG. 2A is a front view of a structure of a movable connector according to a first embodiment.
Figure 2B:
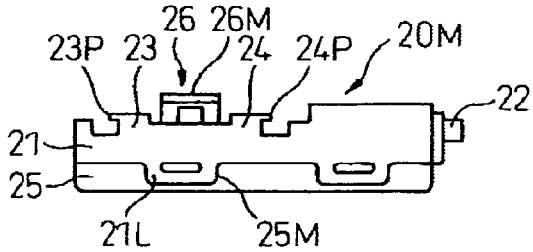
FIG. 2B is a side view of the connector illustrated in FIG. 2A, viewed from a direction B.
Figure 2C:
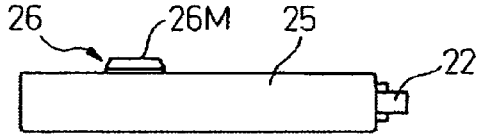
FIG. 2C is a side view of the connector illustrated in FIG. 2A, viewed from a direction C.
Figure 2D:
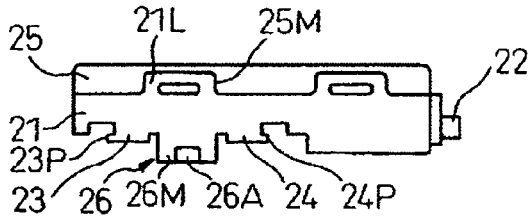
FIG. 2D is a side view of the connector illustrated in FIG. 2A, viewed from a direction D.
Figure 2E:
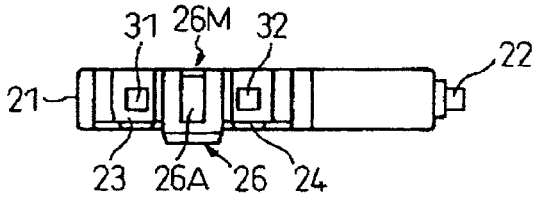
FIG. 2E is a side view of the connector illustrated in FIG. 2A, viewed from a direction E.
Figure 2F:
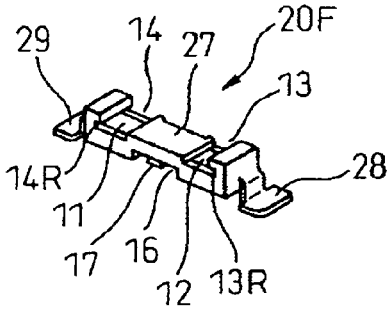
FIG. 2F is a top perspective view of a fixed connector according to the first embodiment.
Figure 2G:
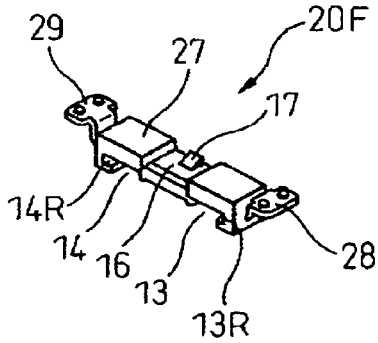
FIG. 2G is a bottom perspective view of the fixed connector illustrated in FIG. 2F.

FIGS. 2A to 2G show a structure of a connector system according to a first embodiment of the invention. FIGS. 2A to 2E show a structure of a movable connector 20M that is a second connector. FIGS. 2F and 2G show a structure of a fixed connector 20F that is a first connector. The movable connector 20M slides to be joined to and removed from the fixed connector 20F. FIG. 2A is a front view of the movable connector 20M. FIG. 2B is a view of the movable connector 20M illustrated in FIG. 2A, viewed from a direction B. FIG. 2C is a view of the movable connector 20M illustrated in FIG. 2A, viewed from a direction C. FIG. 2D is a view of the movable connector 20M illustrated in FIG. 2A, viewed from a direction D. FIG. 2E is a view of the movable connector 20M illustrated in FIG. 2A, viewed from a direction E. FIG. 2F is a top perspective view of the fixed connector 20F, and FIG. 2G is a bottom perspective view of the fixed connector 20F.

Being electrically connected to a terminal of a vehicle antenna, the fixed connector 20F is fixed. The movable connector 20M is connected to a cable 22 for transmittance of received signals received by a vehicle antenna to a signal receiving apparatus using the received signals. By joining the movable connector 20M to the fixed connector 20F, the movable connector 20M is electrically connected to the fixed connector 20F and the received signals received by the vehicle antenna are transmitted to the receiving apparatus.

Here, a structure of the movable connector 20M is described. The movable connector 20M includes a bottom case 21 and a top case 25. The cable 22 is connected to the bottom case 21. The bottom case 21 and the top case 25 can be made from synthetic resin. A circuit board, described later, is housed in the bottom case 21. Two U-shaped grooves 25M, open to end faces of the bottom case 21, are placed on both longer sides of the top case 25 with a predetermined distance being kept therebetween. Loop-shaped parts 21L of upper end faces of the bottom case 21 are fitted in the U-shaped grooves 25M and the top case 25 is fixed with the bottom case 21.

The bottom surface of the bottom case 21 has two slide protrusions 23 and 24 extended in a shorter side direction (in the direction that the movable connector 20M is joined or removed) perpendicular to the longer side of the bottom case 21. The slide protrusions 23 and 24 have stopper protrusions 23P and 24P on respective side surfaces thereof along a direction in which the slide protrusions 23 and 24 are extended, for preventing the slide protrusions 23 and 24 from slipping out of slide grooves described later. Uncovered connecting terminals 31 and 32 are placed, on top surfaces (bottom surfaces viewed from the bottom case 21) of the slide protrusions 23 and 24, for electrically connecting to a circuit board, described later, in the bottom case 21. The connecting terminals 31 and 32 are placed on a surface facing the fixed connector 20F when the movable connector 20M is joined to the fixed connector 20F.

A lock mechanism 26 is placed between the protrusions 23 and 24, for fixing the movable connector 20M to the fixed connector 20F. The lock mechanism 26 includes two arms 26M and a lock hole 26A. The two arms 26M stand from one end portion of the bottom surface of the bottom case 21, bend to be parallel with the bottom surface of the bottom case 21, and then the leading ends of the two arms are joined. The lock hole 26A is placed, surrounded on three sides by the two arms 26M and the leading ends, and the leading ends of the arms 26M are extended beyond a side surface of the bottom case 21. The slide protrusions 23 and 24 slide toward and join to the slide grooves 13 and 14, from a longer side of the connector system. The slide protrusion 23 and 24, and the slide grooves 13 and 14 are extended in a direction that the slide protrusions 23 and 24 slide to engage with the slide grooves 13 and 14.

Next, a structure of the fixed connector 20F is described. The fixed connector 20F, as shown in FIG. 2F and FIG. 2G, includes a body 27 and legs 28 and 29 attached to the body 27. The fixed connector 20F has the slide grooves 13 and 14 for accommodating the slide protrusions 23 and 24 on a side of the body 27 where the fixed connector 20F is joined with the movable connector 20M. Stopper grooves 13R and 14R are formed for accommodating the stopper protrusions 23P and 24P and placed at positions corresponding to the stopper protrusions 23P and 24P, respectively on side surfaces of the slide grooves 13 and 14. The stopper protrusions 23P and 24P are respectively inserted in the stopper grooves 13R and 14R. Uncovered electrodes 11 and 12, for being electrically connected to the legs 28 and 29, are placed on the bottom surfaces of the slide grooves 13 and 14. The electrodes 11 and 12 are placed on a surface facing the movable connector 20M when the fixed connector 20F is joined to the movable connector 20M.

The slide protrusions 23 and 24 engage with the slide grooves 13 and 14 from a longer side of the connector system, and then are slid. The slide protrusion 23 and 24 and the slide grooves 13 and 14 are extended in a direction that the slide protrusions 23 and 24 slide to engage with the slide grooves 13 and 14. In other words, the slide protrusions 23 and 24 and the slide grooves 13 and 14 slide in a direction that the slide protrusions 23 and 24 and the slide grooves 13 and 14 are extended, and thus the slide protrusions 23 and 24 are respectively fitted in the slide grooves 13 and 14. After the fit, engagement of the stopper protrusions 23P and 24P with the stopper grooves 13R and 14R limits slide distance of the slide protrusions 23 and 24 in a direction perpendicular to a sliding direction and prevents the slide protrusions 23 and 24 from sliding out of the slide grooves 13 and 14.

The legs 28 and 29, attached on both sides of the body 27, bend so as to allow for a predetermined gap between the body 27 and a flat mounting surface when the legs 28 and 29 touch the surface. The predetermined gap is described later. The slide grooves 13 and 14 are placed on a surface opposite to a surface where the legs 28 and 29 are placed. The slide grooves 13 and 14 are extended along the mounting surface where the legs 28 and 29 touch and in a shorter side direction perpendicular to the longer side of the body 27. Therefore, the slide protrusions 23 and 24 and the slide grooves 13 and 14 slide in the shorter side direction of the body 27 approximately in parallel with the mounting surface and the slide protrusions 23 and 24 are fitted in the slide grooves 13 and 14.

Moreover, there is a lock concavity 16, for accommodating the arms 26M of the lock mechanism 26 placed on the movable connector 20M, on a mounting surface where the body 27 is fixed (an opposite surface where the body 27 is joined to the movable connector 20M), and a lock protrusion 17, for engaging with the lock hole 26A of the lock mechanism 26, in the lock concavity 16. When the slide protrusions 23 and 24 are completely accommodated in the slide grooves 13 and 14, the lock protrusion 17 engages with the lock hole 26A of the lock mechanism 26. Thereby, the movable connector 20M remains joined to the fixed connector 20F.

The legs 28 and 29 of the fixed connector 20F in a structure mentioned above are different from each other because they are used for different purposes such as for receiving signals or for grounding. These legs 28 and 29 may be attached to the body 27 by insert molding.

Figure 3A:
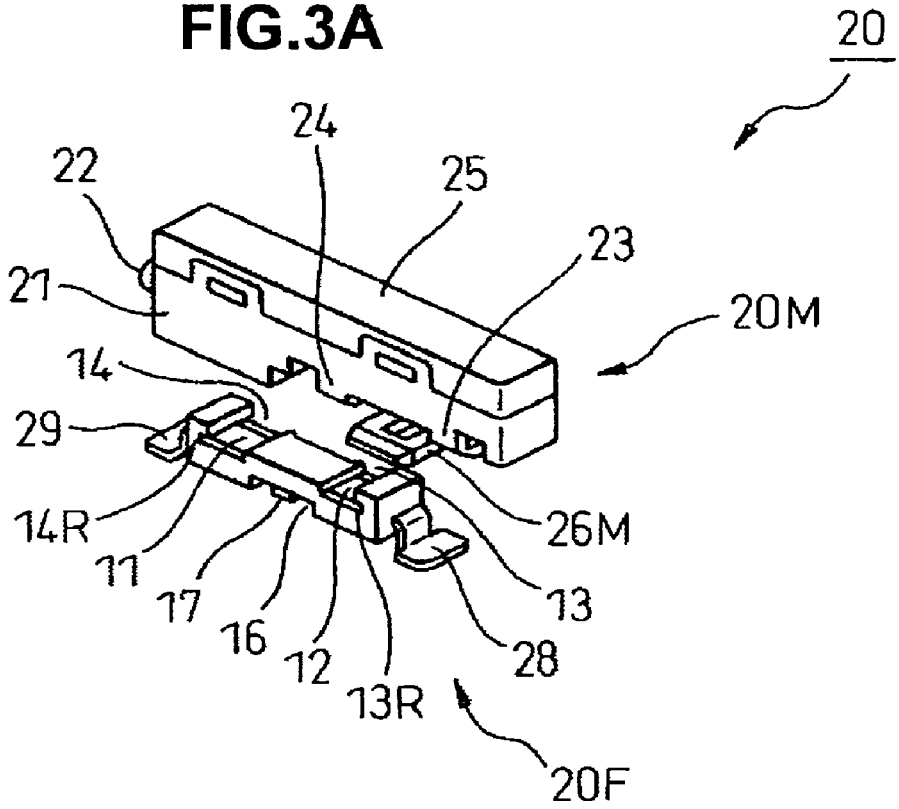
FIG. 3A is a top perspective view showing a state where the movable connector is joined to the fixed connector.
Figure 3B:
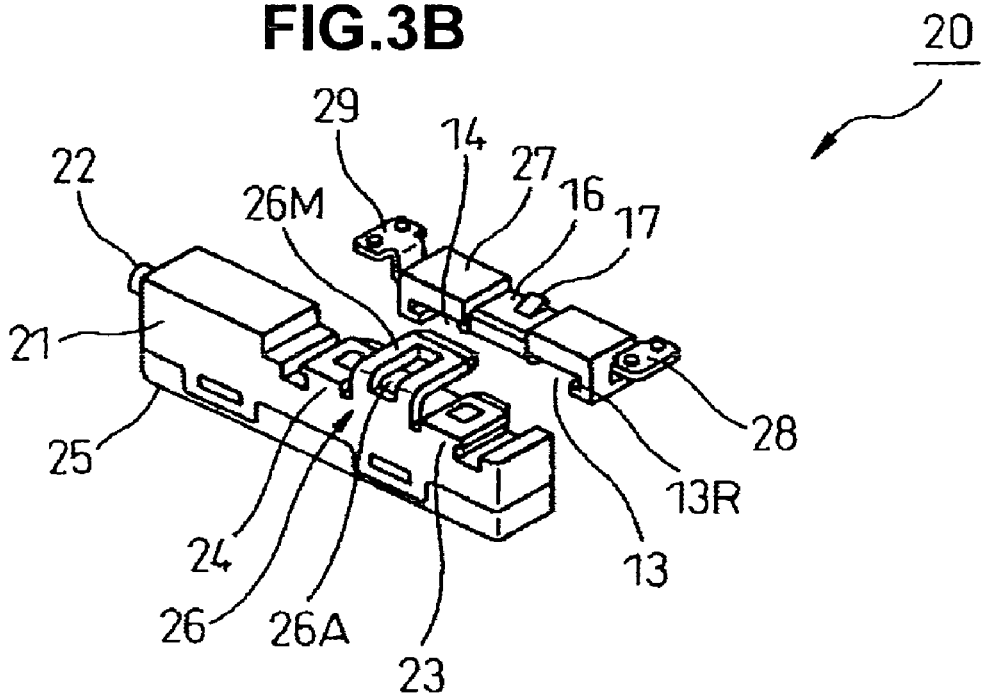
FIG. 3B is a bottom perspective view showing a state where the movable connector is joined to the fixed connector.

FIGS. 3A and 3B show how the connector system 20 is assembled by connecting the movable connector 20M to the fixed connector 20F according to the first embodiment of the invention, illustrated in FIGS. 2A to 2G. FIG. 3A is a top perspective view and FIG. 3B is a bottom perspective view. The fixed connector 20F is fixed beforehand on a mounting surface, i.e., a fixed vehicle glass plate, where an antenna is installed. At the same time, the legs 28 and 29 are electrically connected to an antenna terminal by soldering or another method.

Steps for connecting the movable connector 20M to the fixed connector 20F are:

first, the movable connector 20M is faced to the fixed connector 20F that has been fixed, with the fixed connector 20F facing the leading ends of the arms 26M of the lock mechanism 26 of the movable connector 20M;

second, the leading ends of the arms 26M, extended beyond a side of the bottom case 21 of the movable connector 20M, are inserted into the lock concavity 16 of the fixed connector 20F. In the process of the insertion, the slide protrusions 23 and 24 on the bottom surface of the bottom case 21 of the movable connector 20M are inserted into the slide grooves 13 and 14 of the fixed connector 20F. The edges on the inserted sides of the slide protrusions 23 and 24 according to this embodiment are tapered for easy insertion to the fixed connector 20F.

Slide of the movable connector 20M to the fixed connector 20F stops with a base side of the arms 26M of the lock mechanism 26 touching the base of the fixed connector 20F. At the same time, a side surface of the movable connector 20M is flush with a side surface of the fixed connector 20F, and the lock protrusion 17 of the lock concavity 16 is fitted in the lock hole 26A. As a result, the movable connector 20M is locked in the fixed connector 20F and remains joined to the fixed connector 20F.

Figure 4B:
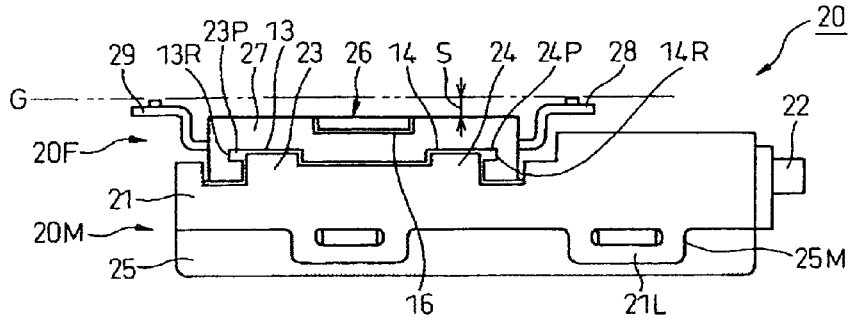
FIG. 4B is a side view of the connector illustrated in FIG. 4A, viewed from a direction B.
Figure 4A:
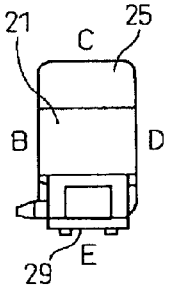
FIG. 4A is a front view showing the movable connector joined to the fixed connector.
Figure 4C:
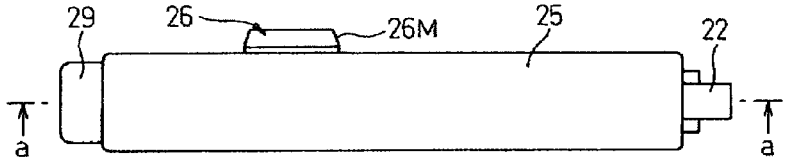
FIG. 4C is a side view of the connector illustrated in FIG. 4A, viewed from a direction C.
Figure 4D:
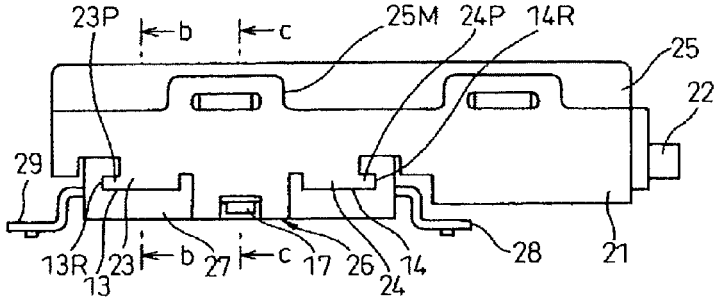
FIG. 4D is a side view of the connector illustrated in FIG. 4A, viewed from a direction D.
Figure 4E:
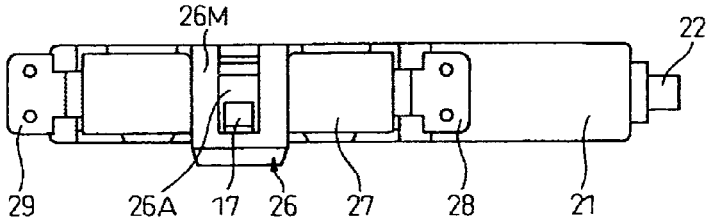
FIG. 4E is a side view of the connector illustrated in FIG. 4A, viewed from a direction E.

FIGS. 4A to 4E show the connector system 20 where the movable connector 20M is joined with the fixed connector 20F having the aforementioned structure. FIG. 4A is a front view of the connector system 20. FIG. 4B is a side B of the connector system 20 illustrated in FIG. 4A. FIG. 4C is a side C of the connector system 20 illustrated in FIG. 4A. FIG. 4D is a side D of the connector system 20 illustrated in FIG. 4A. FIG. 4E is a side E of the connector system 20 illustrated in FIG. 4A. As elements of the connector system 20 are described in FIGS. 2A to 2G, the same elements illustrated in FIGS. 4A to 4E are given the same reference numerals and their explanations are omitted here.

A gap S is described here. The gap S is formed when legs 28 and 29 attached to the both sides of the body 27 of the fixed connector 20F are fixed to a mounting surface G, illustrated by a chain double-dashed line. The two arms 26M of the lock mechanism 26 stand from the bottom case 21, bend and are extended in parallel with the bottom surface of the bottom case 21. The leading ends of the arms 26M can bend to and against the base. The gap S is for allowing the leading ends of the arms 26M to bend to the mounting surface G by an outside pressure. When the leading end of the lock mechanism 26 is bent to the mounting surface G, the lock mechanism 26 is unlocked and separated from the lock protrusion 17. Thereby, the fixed connector 20F can be removed from the movable connector 20M.

Figure 5A:
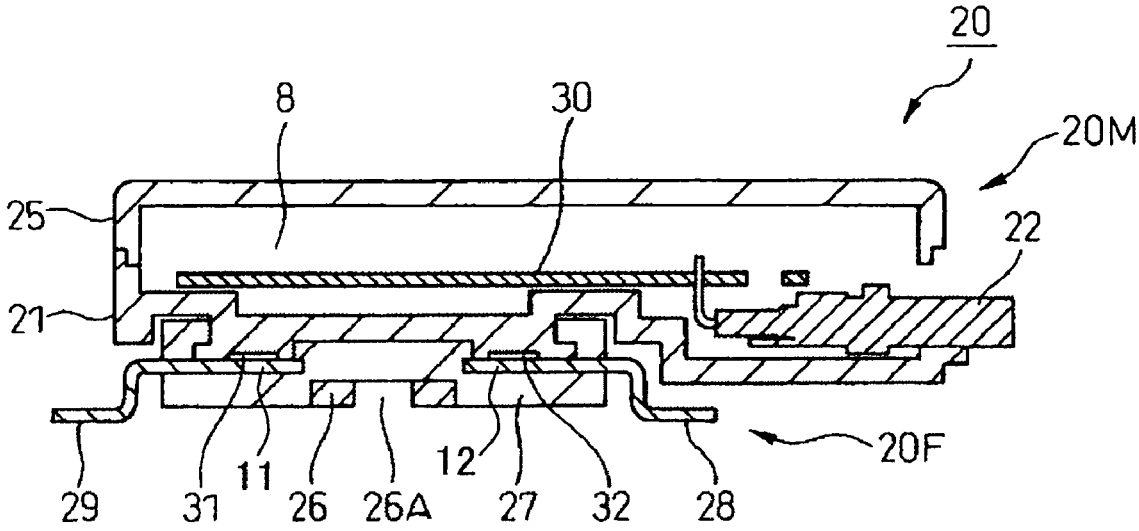
FIG. 5A is a sectional view taken along the line a-a in FIG. 4C.
Figure 5B:
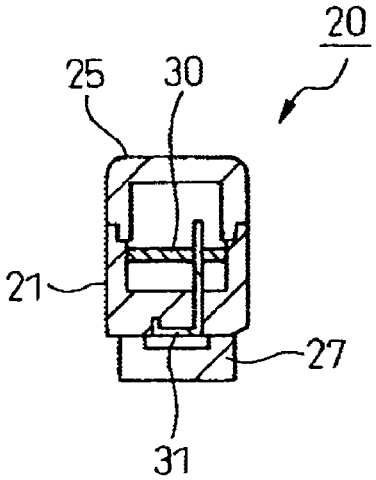
FIG. 5B is a sectional view taken along the line b-b in FIG. 4D.
Figure 5C:
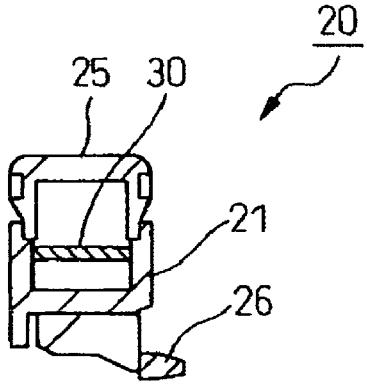
FIG. 5C is a sectional view taken along the line c-c in FIG. 4D.

FIG. 5A is a sectional view of the connector system 20 taken along the line a-a in FIG. 4C. FIG. 5B is a sectional view of the connector system 20 taken along the line b-b in FIG. 4D. FIG. 5C is a sectional view of the connector system 20 taken along the line c-c in FIG. 4D. FIGS. 5A to 5C show internal structures of the connector system 20 which are not illustrated in FIGS. 2A to 2G and FIGS. 4A to 4E. As illustrated in FIG. 5A to 5C, the connector system 20 includes a circuit board 30 in an inner space 8 enclosed by the top case 25 and the bottom case 21. The cable 22 is connected to the circuit board 30.

With the movable connector 20M being joined with the fixed connector 20F, the uncovered connecting terminals 31 and 32 respectively on the slide protrusions 23 and 24 of the movable connector 20M touch and are electrically connected to the electrodes 11 and 12 in the slide grooves 13 and 14 of the fixed connector 20F. Also, as illustrated in FIG. 5B (only the connecting terminal 31 is illustrated in the figure), the connecting terminals 31 and 32 are connected to a circuit on the circuit board 30 by pins protruding on the connecting terminals 31 and 32. A structure of the circuit board 30 is illustrated in FIG. 6A.

Figure 6A:
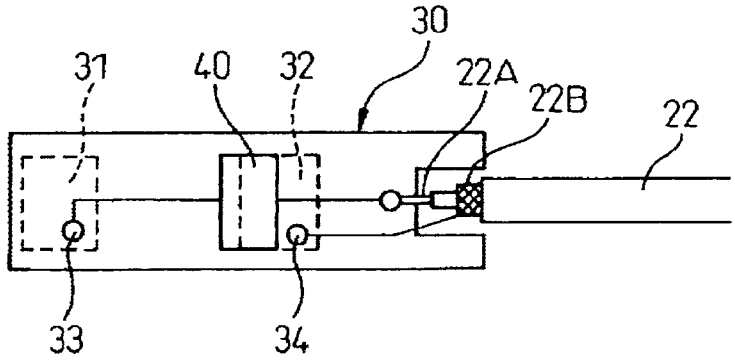
FIG. 6A is a plan view of an exemplary circuit board, illustrated in FIG. 5A, viewed from a surface.

FIG. 6A shows an exemplary structure of the circuit board 30 illustrated in FIGS. 5A to 5C, excluding the bottom case 21 and the top case 25. The connecting terminals 31 and 32 on the bottom case 21 illustrated by a broken line are conducted to the circuit board 30 via the pins, as described above, and then connected to a circuit on an upper surface of the circuit board 30 via through holes 33 and 34. According to this embodiment, the through hole 33 is electrically connected to an input terminal of an integrated circuit 40 mounted on the upper surface of the circuit board 30 and the through hole 34 is connected to a ground wire (outside conductor) 22B of the cable 22, via a circuit. The integrated circuit 40 is for amplifying received signals received by an antenna, and the processed signals are output to a center conductor (inside conductor) 22A of the cable 22.

According to this embodiment, a part of the circuit board 30 is cut out. However, a part of the circuit board 30 may not be cut out. The center conductor 22A of the cable 22 may be connected to a circuit board via a through hole of the circuit board 30 from a backside of the circuit board 30, as illustrated in FIG. 5A.

Figure 6B:
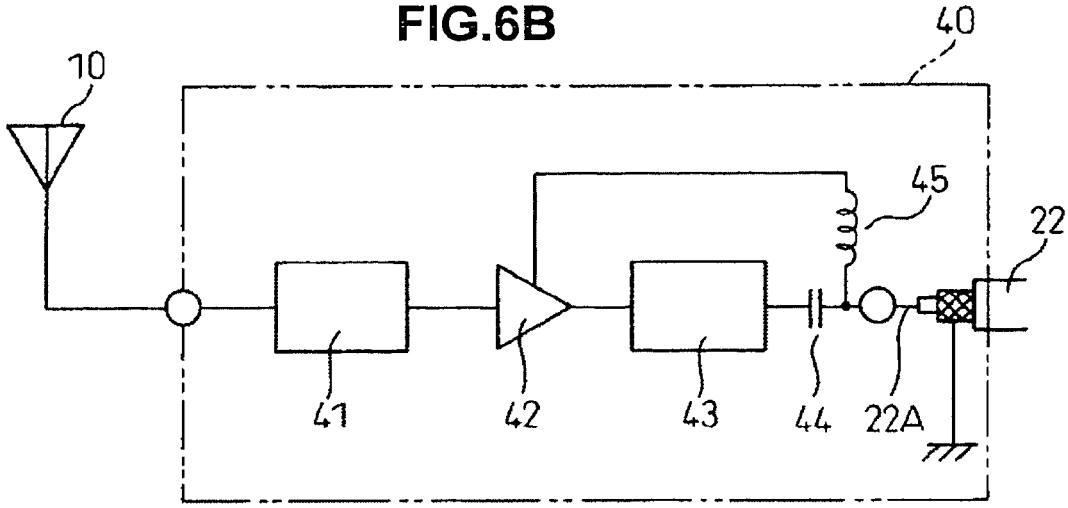
FIG. 6B is a block circuit diagram showing an inside structure of an amplifier mounted on the circuit board illustrated in FIG. 6A.

FIG. 6B shows an internal structure of the integrated circuit 40 illustrated in FIG. 6A. The integrated circuit 40 internally includes a filter 41 for connecting to an antenna 10, an amplifier 42 for amplifying signals output from the filter 41, and a filter 43 for determining bandwidth of signals output from the amplifier 42. The filter 43 is connected to the center conductor 22A of the cable 22 via a capacitor 44 blocking the direct current. The cable 22 is a superposed power cable. Superposition power voltage (direct current) is provided to the amplifier 42 via a coil 45 blocking alternating current component.

Figure 6C:
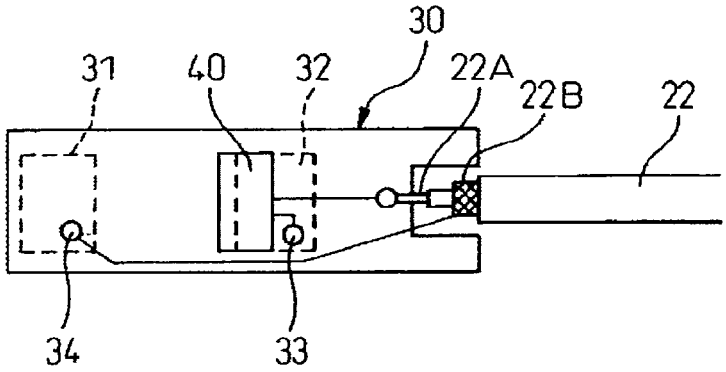
FIG. 6C is a plan view of another exemplary circuit board, illustrated in FIG. 5.

Excluding the bottom case 21 and the top case 25, FIG. 6C shows a structure of the circuit board 30 of the connector system 20, being different from the one illustrated in FIG. 6A. According to the circuit board 30 of the connector system 20 illustrated in FIG. 6A, the connecting terminal 31 is an ungrounded (signal transmitting) terminal and is connected to an input terminal of the integrated circuit 40 via the through hole 33; and the connecting terminal 32 that is a grounded terminal and is connected to the ground wire 22B of the cable 22 via the through hole 34. On the other hand, according to the circuit board 30 of the connector system 20 illustrated in FIG. 3C, the connecting terminal 31 is a grounded terminal and is connected to the ground wire 22B of the cable 22 via the through hole 34 and a circuit; and the connecting terminal 32 that is an ungrounded (signal transmitting) terminal and is connected to an input terminal of the integrated circuit 40 via the through hole 33 and a circuit. The connecting terminal 31, as just described, can be a grounded terminal and the connecting terminal 32 can be an ungrounded terminal.

According to the aforementioned embodiment, the movable connector 20M includes the slide protrusions 23 and 24 and the stopper protrusions 23P and 24P, and the fixed connector 20F includes the slide grooves 13 and 14 and the slide stopper grooves 13P and 14P. However, the movable connector 20M may include the slide grooves 13 and 14 and the slide stopper grooves 13P and 14P, and the fixed connector 20F may include the slide protrusions 23 and 24 and the stopper protrusions 23P and 24P. As for the lock mechanism 26, the fixed connector 20F may include the lock arms 26M having a lock hole 26A and the movable connector 20M may include the lock concavity 16 and the lock protrusion 17.

Figure 7A:
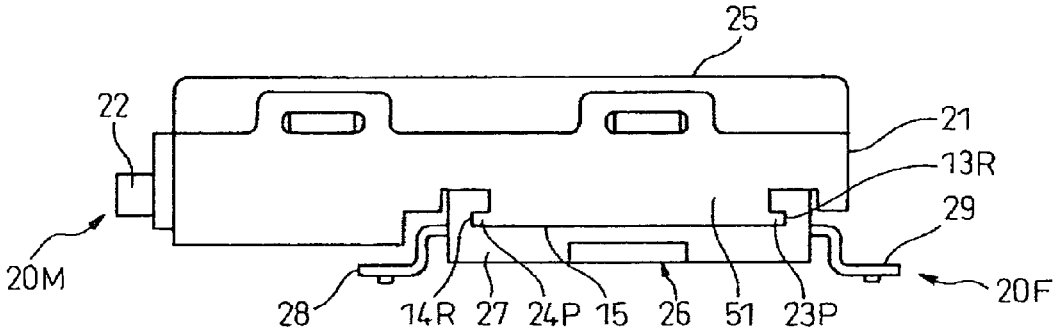
FIG. 7A shows a structure having a protrusion placed on the bottom surface of the movable connector.
Figure 7B:
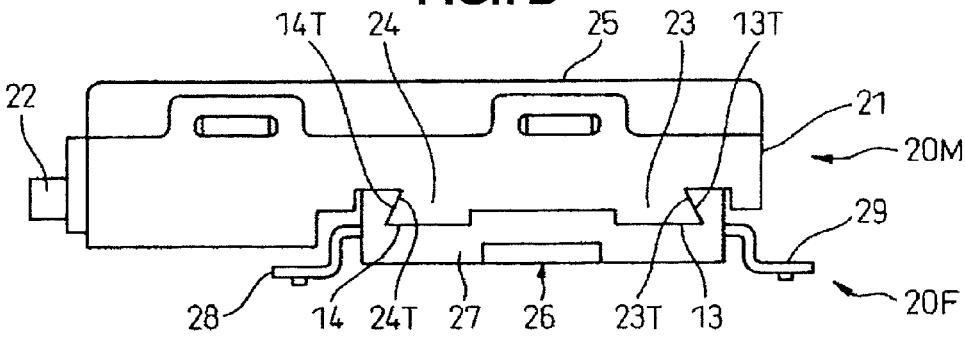
FIG. 7B shows a structure of a tapered stopper mechanism for preventing the movable connector from sliding out of the fixed connector.
Figure 7C:
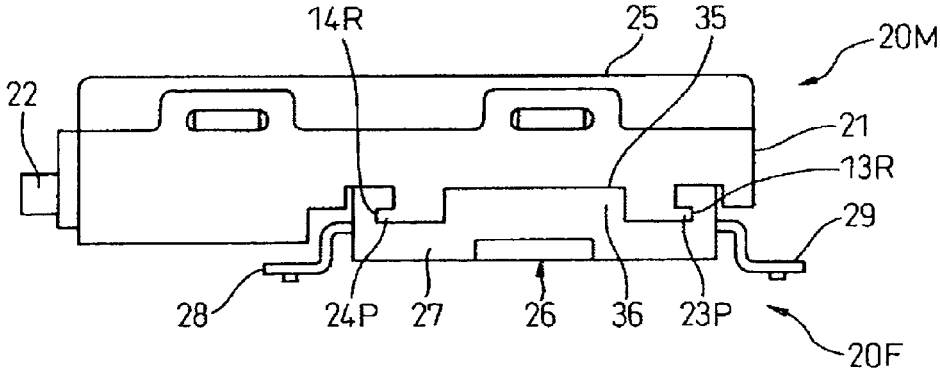
FIG. 7C shows a structure of the movable connector having slide grooves and the fixed connector having slide protrusions.

FIGS. 7A to 7C show a structure of a modification of the connector system according to the first embodiment of the invention. According to the aforementioned embodiment, the bottom surface of the movable connector 20M has the slide protrusions 23 and 24. According to the modification illustrated in FIG. 7A, the bottom surface of the movable connector 20M has a slide protrusion 51. Accordingly, the body 27 of the fixed connector 20F has one slide groove 15 only. As the other elements of this embodiment are the same as the ones of the first embodiment, the same elements are given the same reference numerals and their explanations are omitted.

A modification illustrated in FIG. 7B is different from the first embodiment in terms of a mechanism for preventing the slide protrusions 23 and 24 located on the bottom surface of the movable connector 20M from slipping out of the slide grooves 13 and 14 of the fixed connector 20F. According to the first embodiment, the stopper protrusions 23P and 24P located on side surfaces of the slide protrusions 23 and 24 engage with the stopper grooves 13R and 14R located in the slide grooves 13 and 14 and thus prevent the slide protrusions 23 and 24 from slipping out of the slide grooves 13 and 14. According to this modification, side surfaces 23T and 24T of the slide protrusions 23 and 24 are tapered for engaging with reverse-tapered side surfaces 13T and 14T of the slide grooves 13 and 14 to prevent the slide protrusions 23 and 24 from slipping out of the slide grooves 13 and 14. As the other elements of this embodiment are the same as the ones of the first embodiment, the same elements are given the same reference numerals and their explanations are omitted.

A modification illustrated in FIG. 7C shows a structure where a slide groove 35 is located on the bottom surface of the movable connector 20M and a slide protrusion 36 is located on the upper surface of the fixed connector 20F. The slide groove 35 and the slide protrusion 36 are respectively located on the movable connector 20M and the fixed connector 20F, being opposite to the first embodiment. A stopper mechanism for preventing the movable connector 20M from slipping out of the fixed connector 20F is the same as the first embodiment. As the other elements of this modification are the same as the ones of the first embodiment, the same elements are given the same reference numerals and their explanations are omitted.

2. Second Embodiment

Figure 8A:
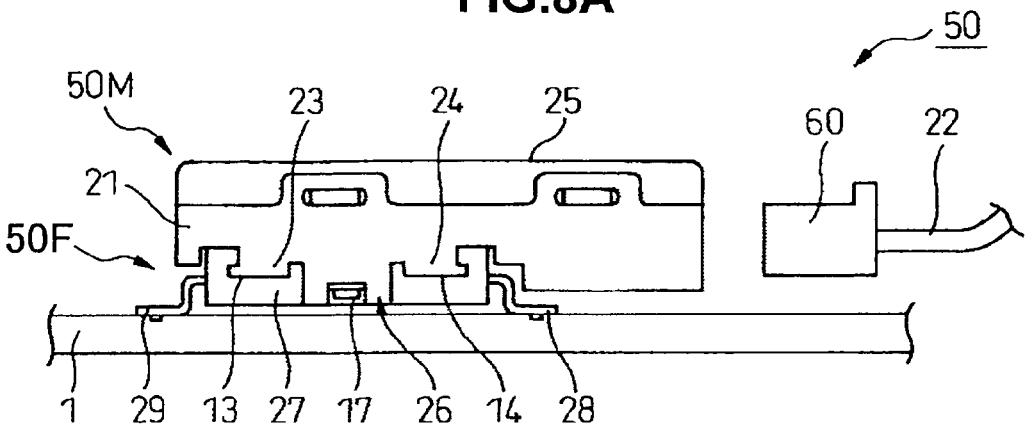
FIG. 8A is a side view showing a structure of a connector system for a vehicle antenna according to a second embodiment.
Figure 8B:
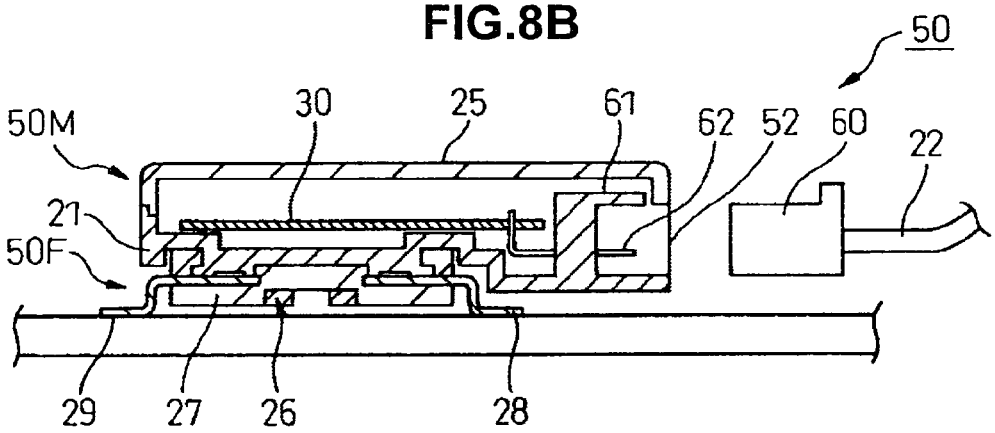
FIG. 8B is a sectional view of the connector system illustrated in FIG. 8A, taken along the length thereof.
Figure 8C:
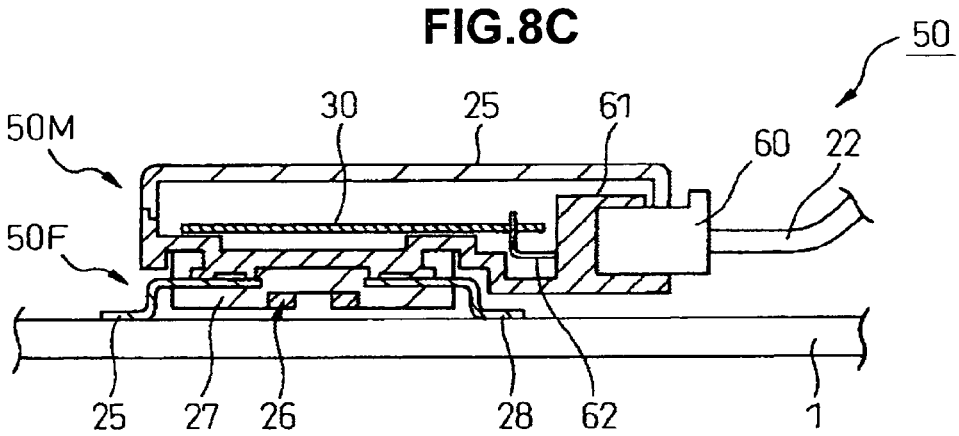
FIG. 8C is a sectional view of the connector system, illustrated in FIG. 8B, to which a connector attached to a cable is joined.

FIG. 8A shows a structure of a connector system 50 for a vehicle antenna according to a second embodiment of the invention. FIG. 8B is a sectional view of the connector system 50 illustrated in FIG. 8A. According to the second embodiment, a method for connecting a cable 22 to the connector system 50 is different from the one to the connector system 20 according to the first embodiment. As illustrated in FIG. 5A, the cable 22 is directly drawn into the connector system 20 and soldered to connect to the circuit board 30 in the connector system 20.

The connector system 50 according to the second embodiment, as illustrated in FIG. 8A, includes a fixed connector 50F, a movable connector 50M, and a removable connector 60. The fixed connector 50F can be the same as the fixed connector 20F according to the first embodiment. The movable connector 50M can be materialized by replacing only a cable connecting part of the movable connector 20M according to the first embodiment with a connector 61, and other elements can be the same as the ones of the movable connector 20M according to the first embodiment. Thus, as the other elements of this embodiment are the same as the ones of the first embodiment, the same elements are given the same reference numerals and their explanations are omitted.

According to the second embodiment, a male connector 61 is insert-molded on a cable-connected side of the bottom case 21 of the movable connector 50M, and a pin 62 of the male connector 61 is connected to an output terminal of the circuit board 30. An opening 52 for insertion of the removable connector 60 is molded on a cable-connected side of the movable connector 50M. A leading end of the cable 22 has the female removable connector 60 for joining to the male connector 61. As a result, the movable connector 50M is connected to the cable 22 by connecting the removable connector 60 to the male connector 61 through the opening 52 of the movable connector 50M.

When the connector system 50 composed according to the second embodiment has a problem with an integrated circuit 40 mounted on the circuit board 30 in the movable connector 50M, the removable connector 60 is removed from the movable connector 50M and only the troubled movable connector 50M can be replaced with a good movable connector 50M.

Figure 9A:
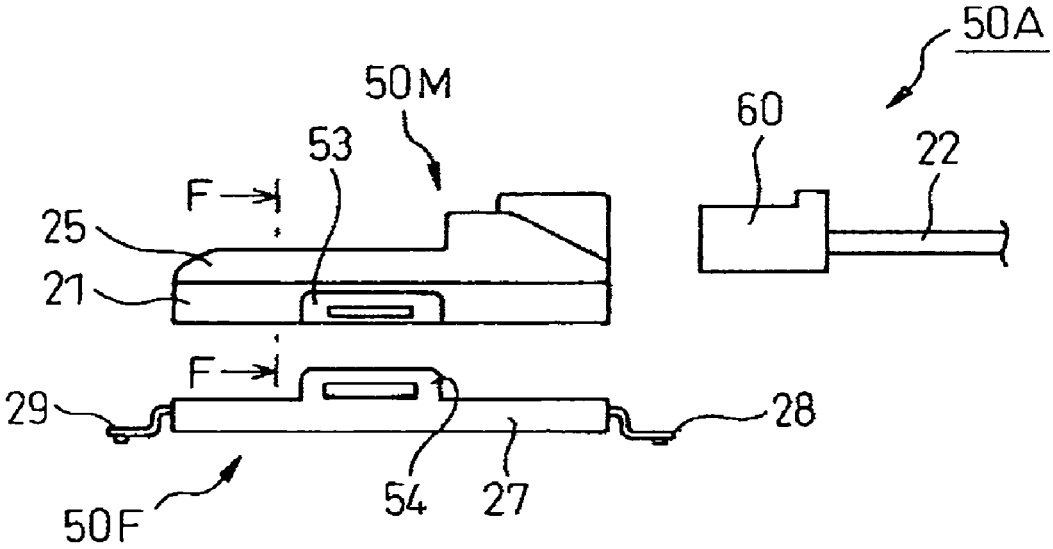
FIG. 9A is a side view of another exemplary structure of the connector system for a vehicle antenna illustrated in FIG. 8A according to the second embodiment.
Figure 9B:
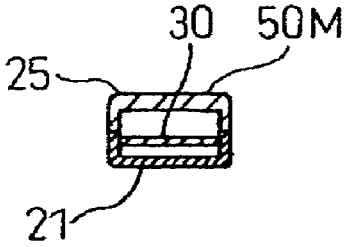
FIG. 9B is a sectional view taken along the line F-F in FIG. 9A.
Figure 10:
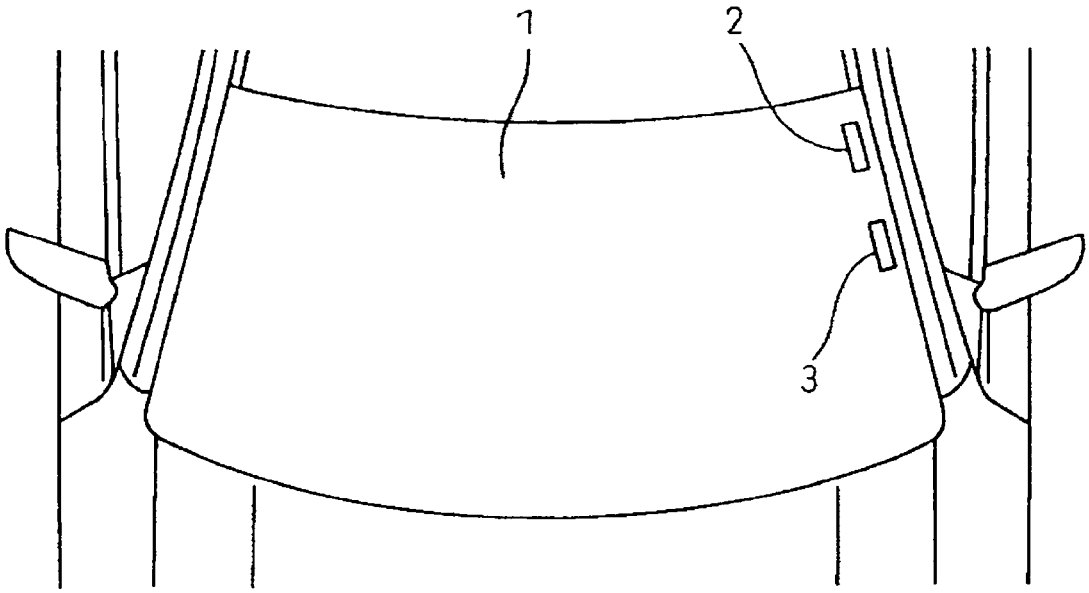
FIG. 10 is a partial plan view of a vehicle showing a position of connector systems for a vehicle antenna.

FIG. 9A shows a structure of a connector system 50A that is another embodiment of a connector system 50 for a vehicle antenna according to the second embodiment. FIG. 9B is a sectional view of the connector system 50A taken along the line F-F in FIG. 9A. The connector system 50A according to this embodiment is different in terms of the movable connector 50M being joined to the fixed connector 50F perpendicular, not in parallel, to a direction in which the connector system 50A is mounted. The mechanism for joining the bottom case 21 to the top case 25 according to the first and second embodiments can be used for joining the fixed connector 50F to the movable connector 50M of the connector system 50A.

In other words, a U-shaped groove 53 is located on a side surface of the bottom case 21 of the movable connector 50M. A loop-shaped part 54 is located on the side surface of the body 27 of the fixed connector 50F. The loop-shaped part 54 is joined to the U-shaped groove 53 to fix the movable connector 50M to the fixed connector 50F.

A connector system of a vehicle antenna is, for a reason of appearance, inconspicuously installed on trim on an inner surface of a vehicle cabin. Therefore, it is preferable that the height and width of a connector system be as small as possible. In the connector systems 20 and 50 of the embodiment, composed as described above, the movable connector is joined to the fixed connector by sliding in a direction parallel with the width (a shorter side) of the connectors. As for a lock mechanism, a lock part located on the movable connector is inserted in a groove located of the fixed connector, and a complex mechanism that makes the connector systems thick is unnecessary. As a result, the connector systems can remain thin.

Difference in width of slide protrusions of a removable connector eliminates a possibility of a movable connector being inserted in its unpaired fixed connector. In the connector system according to the aforementioned embodiment, the movable connector is slid to join to the fixed connector, normally in the direction from the center of a vehicle window.

3. Third Embodiment

For a structural reason of the lock mechanism 26, the connector systems 20 and 50 according to the aforementioned first and second embodiments, the movable connectors 20M and 50M are slid from respective one sides of the fixed connectors 20F and 50F, to join to the fixed connectors 20F and 50F, respectively. With reference to FIGS. 11A to 11I, FIGS. 12A to 12D, FIG. 13A to 13D, and FIG. 14A to 14E, a connector system 70 according to a third embodiment is described as a connector system having a lock mechanism changed for allowing a movable connector to be slid from any of two sides of the fixed connector, to join to a fixed connector. The lock mechanism is the only difference between the connector system 70 according to the third embodiment and the connector systems 20 and 50 according to the first and second embodiments. Therefore, the same elements as the ones of the connector systems 20 and 50 according to the first and second embodiments are given the same reference numerals and their explanations are omitted.

Figure 11A:
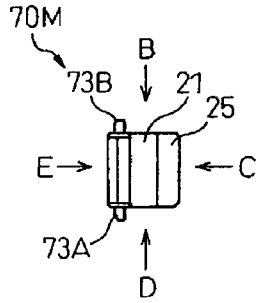
FIG. 11A is a front view of a structure of a movable connector according to a third embodiment.
Figure 11B:
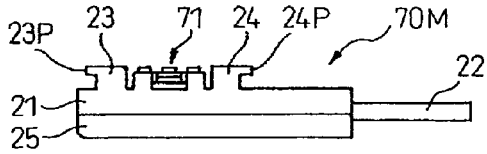
FIG. 11B is a side view of the connector illustrated in FIG. 11A, viewed from a direction B.
Figure 11C:
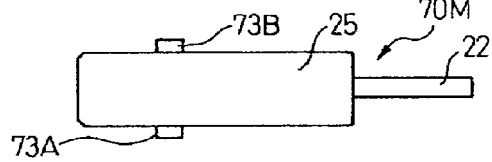
FIG. 11C is a side view of the connector illustrated in FIG. 11A, viewed from a direction C.
Figure 11F:
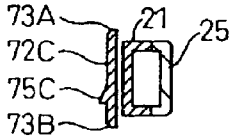
FIG. 11F is a partial sectional view of the connector taken along the line F-F in FIG. 11E.
Figure 11D:
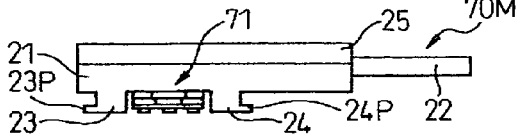
FIG. 11D is a side view of the connector illustrated in FIG. 11A, viewed from a direction D.
Figure 11G:
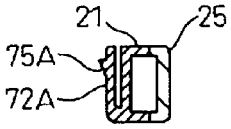
FIG. 11G is a partial sectional view of the connector taken along the line G-G in FIG. 11E.
Figure 11E:
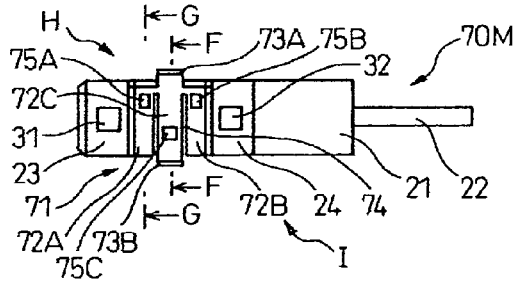
FIG. 11E is a side view of the connector illustrated in FIG. 11A, viewed from a direction E.
Figure 11H:
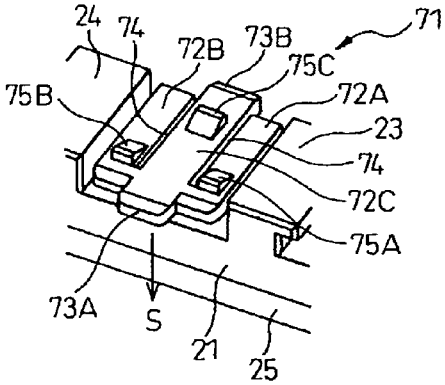
FIG. 11H is a partial top perspective view of the connector, illustrated in FIG. 11E, viewed from a side H.
Figure 11I:
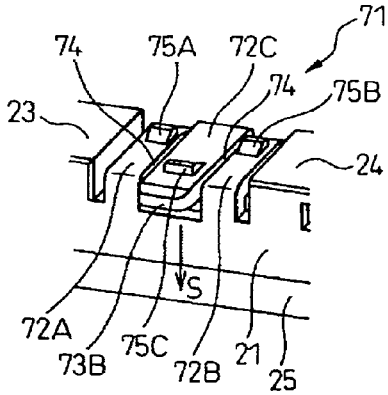
FIG. 11I is a partial top perspective view of the connector, illustrated in FIG. 11E, viewed from a side I.

FIGS. 11A to 11I show a structure of a movable connector 70M of the connector system 70, according to the third embodiment of the invention, including a movable connector and a fixed connector. FIG. 11A is a front view of the movable connector 70M. FIG. 11B, FIG. 11C, FIG. 11D, and FIG. 11E are side views of the movable connector 70M viewed respectively from directions B, C, D, and E illustrated in FIG. 11A. FIG. 11F is a partial sectional view of the movable connector 70M taken along the line F-F in FIG. 11E, and FIG. 11G is a partial sectional view taken along the line G-G in FIG. 11E. FIG. 11H is a perspective view of the movable connector 70M viewed from a direction H illustrated in FIG. 11E, and FIG. 11I is a perspective view of the movable connector 70M viewed from a direction I illustrated in FIG. 11E.

A lock mechanism 71 is located between the two slide protrusions 23 and 24 on the movable connector 70M for fixing the movable connector 70M to the fixed connector. The lock mechanism 71 has three arms 72A, 72B, and 72C. Top surfaces of the three arms 72A, 72B, and 72C are not the same in height as ones of the slide protrusions 23 and 24, and the top surfaces of the arms 72A, 72B, and 72C are lower than the ones of slide protrusions 23 and 24.

The arm 72A is located at a predetermined distance from the arm 72B. The two arms 72A and 72B stand on an edge of the bottom surface of the bottom case 21, bend to be parallel with and above the bottom surface of the bottom case 21, and then the leading ends of the two arms are joined. An unlocking tab 73A is located, at the joint between the arms 72A and 72B, extended beyond a side surface of the bottom case 21. On a side opposite to the unlocking tab 73A on the joint, the third arm 72C is located in parallel with the arm 72A and the arm 72B, and a slit 74 is located between the arms 72C and 74A and another slit 74 is located between the arms 72C and 72B. The arms 72A and 72B stand from one of two side surfaces of the bottom case 21, and the arm 72C stands from the other side surface of the bottom case 21. In other words, the arm 72C stands on a side surface opposite to the one where the arms 72A and 72B stand.

A leading end of the third arm 72C is extended beyond a side of the bottom case 21 and serves as an unlocking tab 73B. Lock protrusions 75A and 75B are respectively located near the leading ends of the arms 72A and 72B, and a lock protrusion 75C is also located near the leading end of the third arm 72C. The lock protrusions 75A and 75B have: surfaces standing vertically to the arms 72A and 72B respectively facing to the leading ends of the arms 72A and 72B; and a surface sloping toward the bases of the arms 72A and 72B. Similarly, a lock protrusion 75C has: surfaces standing vertically to the arm 72C, facing to the leading ends of the arm 72C; and a surface sloping toward the base of the arm 72C.

In such a lock mechanism 71, the leading ends of the arms 72A and 72B can be moved down by pushing down the unlocking tab 73A in a direction S as illustrated in FIG. 11H. Similarly, the leading end of the arm 72C can be moved down by pushing down the unlocking tab 73B in the direction S. Unlocking operation using those unlocking tabs 73A and 73B is described later.

Figure 12A:
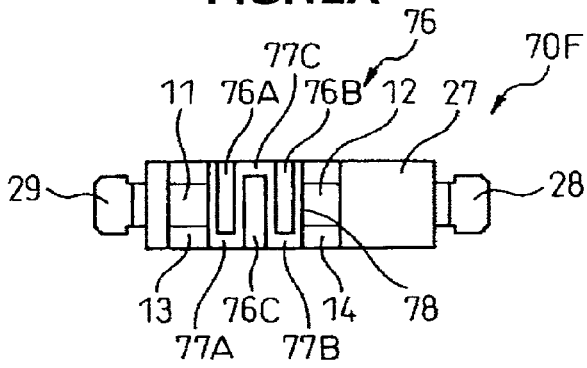
FIG. 12A is an exemplary plan view of a fixed connector to which the movable connector illustrated in FIGS. 11A to 11I is joined.
Figure 12B:
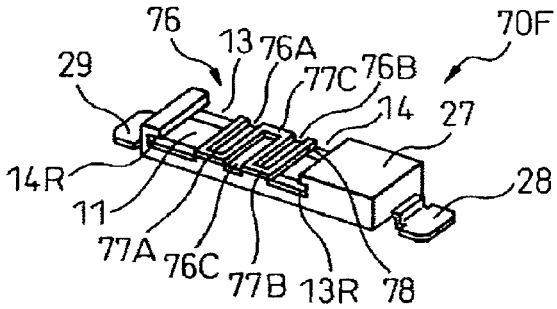
FIG. 12B is a perspective view of the connector illustrated in FIG. 11A.

FIGS. 12A and 12B show a structure of an embodiment of the fixed connector 70F for being joined with the movable connector 70M illustrated in FIGS. 11A to 11I. The body 27 of the fixed connector 70F has a lock mechanism 76, corresponding to the lock mechanism 71 of the fixed connector 70F, located between the slide grooves 13 and 14 for accommodating the slide protrusions 23 and 24 of the movable connector 70M, on a surface joined with the movable connector 70M. The lock mechanism 76 includes three guiding paths 76A, 76B, and 76C, and lock walls 77A, 77B, and 77C, and a guiding wall 78.

The guiding wall 78 includes four parts located evenly spaced apart in parallel with a shorter side of the fixed connector 70F. The guiding wall 78 is as high as difference between the top surfaces of the slide protrusions 23 and 24 on the movable connector 70M and the top surfaces of the arms 72A, 72B, and 72C. The three guiding paths 76A, 76B, and 76C are spaces between two parts of the guiding wall 78. The lock walls 77A, 77B, and 77C, continuing into the guiding walls 78, are respectively located at ends of the three guiding paths 76A, 76B, and 76C. The lock walls 77A and 77B are positioned on the same side and the lock wall 77C is on the opposite side.

Figure 12C:
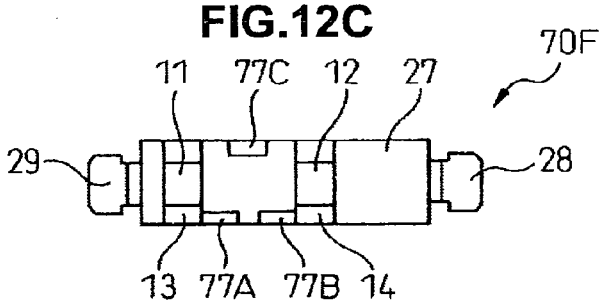
FIG. 12C is another exemplary plan view of a fixed connector to which the movable connector illustrated in FIGS. 11A to 11I is joined.
Figure 12D:
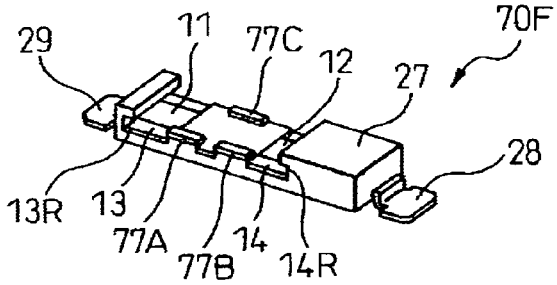
FIG. 12D is a perspective view of the connector illustrated in FIG. 11C.

FIGS. 12C and 12D show a structure of a modification of the embodiment of the fixed connector 70F for being joined with the movable connector 70M illustrated in FIGS. 11A to 11I. No presence of the guiding walls 78 is the only difference between the modification of the fixed connector 70F and the embodiment illustrated in FIGS. 12A and 12B. Therefore, the same elements of the modification as ones of the embodiment shown in FIGS. 12A and 12B are given the same reference numerals and their explanations are omitted. The movable connector 70M composed as described above according to the third embodiment can be joined to the fixed connector 70F from either of longer sides of the fixed connector 70F, which is described hereinbelow with reference to FIGS. 13A to 13D.

Figure 13A:
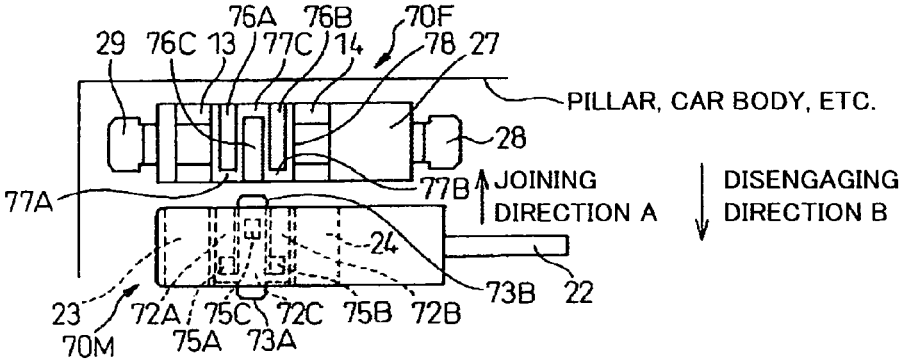
FIG. 13A shows a direction in which the movable connector illustrated

FIG. 13A shows the fixed connector 70F fixed with a longer side thereof, i.e. a side having open ends of the guiding paths 76A and 76B and the lock wall 77C, close to a vehicle front pillar. In this fixing position, the movable connector 70M cannot slide toward the fixed connector 70F to be joined from the vehicle front pillar side.

In this case, with a side having the unlocking tab 73B of the movable connector 70M facing the fixed connector 70F, like the first and second embodiments, the slide protrusions 23 and 24 of the movable connector 70M are inserted into the slide grooves 13 and 14 of the fixed connector 70F, and the movable connector 70M is slid to the fixed connector 70F. During the sliding, a lock protrusion 75C on the arm 72C of the movable connector 70M moves on the guiding path 76C along the guiding wall 78.

Figure 13B:
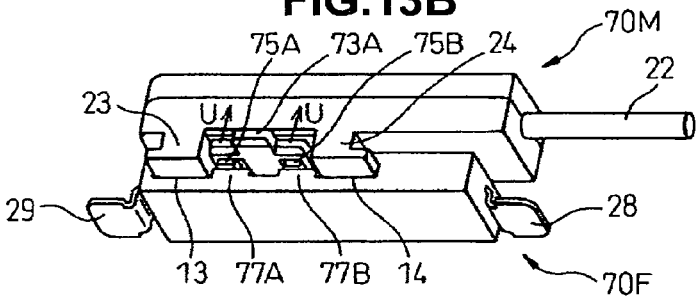
FIG. 13B is a perspective view showing an operation of a lock mechanism when a lock protrusion of the movable connector touches a lock wall of the fixed connector.

The movable connector 70M slides to the fixed connector 70F until the lock protrusions 75A and 75B on the arms 72A and 72B of the movable connector 70M touch the lock walls 77A and 77B of the fixed connector 70F, as illustrated in FIG. 13B. Further sliding of the movable connector 70M forces the lock walls 77A and 77B to slide on the sloped surfaces of the lock protrusions 75A and 75B, because the surfaces of the lock protrusions 75A and 75B slope toward the base of the arms 72A and 72B, and thus the arms 72A and 72B bend in a direction U.

When an edge of the lock protrusion 75C of the movable connector 70M touches the lock wall 77C of the fixed connector 70F, the lock protrusions 75A and 75B slide over the lock walls 77A and 77B, and the bent arms 72A and 72B return to their original positions. At this time, the vertically-standing surfaces of the lock protrusions 75A and 75B engage with the lock walls 77A and 77B. As a result, the movable connector 70M is locked to the fixed connector 70F. The slide protrusions 23 and 24 are completely accommodated in the slide grooves 13 and 14, and the movable connector 70M is joined to the fixed connector 70F.

Figure 14A:
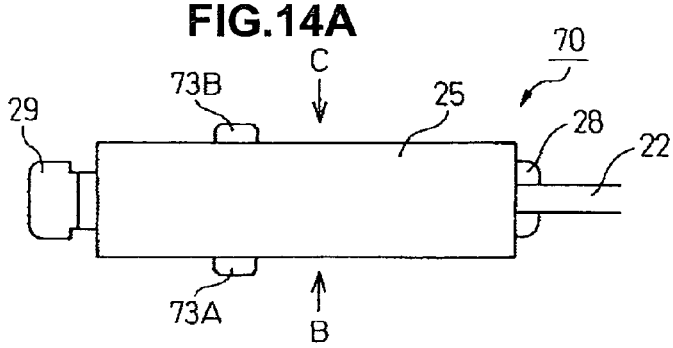
FIG. 14A is a plan view showing the movable connector illustrated in FIGS. 11A to 11I joined to the fixed connector illustrated in FIG. 12A.
Figure 14B:
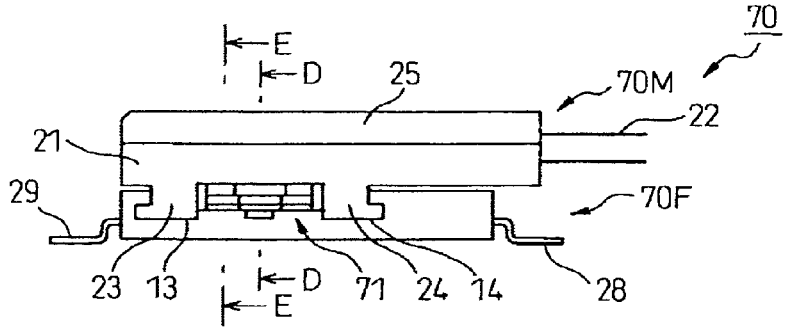
FIG. 14B is a side view of the connector illustrated in FIG. 14A, viewed from a direction B.
Figure 14C:
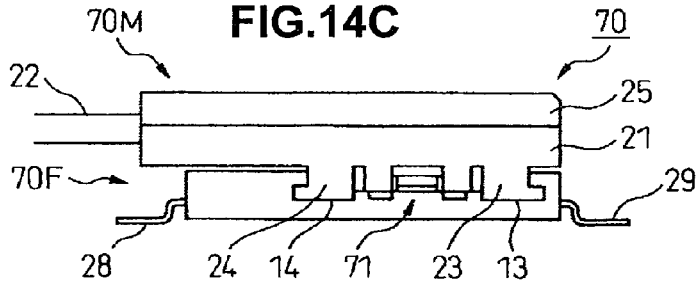
FIG. 14C is a side view of the connector illustrated in FIG. 14A, viewed from a direction C.
Figure 14D:
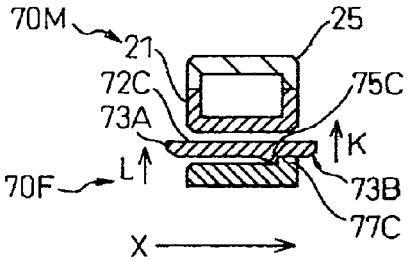
FIG. 14D is a partial sectional view of the connector taken along a line D-D in FIG. 14B.
Figure 14E:
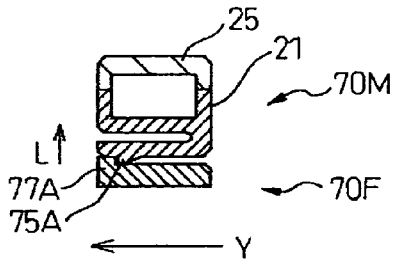
FIG. 14E is a partial sectional view of the connector taken along a line E-E in FIG. 14B.

FIGS. 14A to 14E show the movable connector 70M joined with the fixed connector 70F by the aforementioned sliding. FIG. 14B is a side view of the connector system viewed from a direction B illustrated in FIG. 14A. FIG. 14C is a side view of the connector system viewed from a direction C illustrated in FIG. 14A. FIG. 14D shows a partial sectional view of the connector system taken along the line D-D in FIG. 14B. FIG. 14E shows a partial sectional view of the connector system taken along the line E-E in FIG. 14B.

As illustrated in FIGS. 14D and 14E, when the movable connector 70M is joined with the fixed connector 70F, the edge of the lock protrusion 75C of the movable connector 70M touches the lock wall 77C of the fixed connector 70F, and an edge of the lock protrusion 75A touches the lock wall 77A. An edge of the lock protrusion 75B touches the lock wall 77B (not illustrated). Therefore, in this state, the movable connector 70M is not removed from the fixed connector 70F.

Figure 13C:
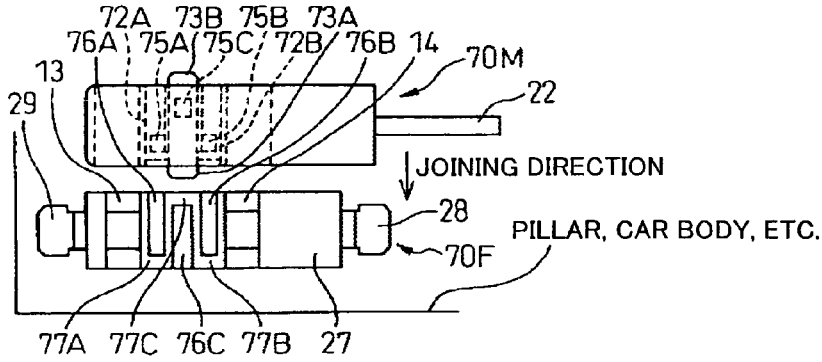
FIG. 13C shows a direction in which the movable connector illustrated

FIG. 13C shows the fixed connector 70F fixed with the other longer side thereof, i.e. a side having the lock walls 77A and 77B and an open end of the guiding path 76C, close to a vehicle front pillar. In this fixing position, the movable connector 70M cannot slide toward the fixed connector 70F to be joined from the vehicle front pillar side.

In this case, with a side having the unlocking tab 73A of the movable connector 70M facing the fixed connector 70F, like the first and second embodiments, the slide protrusions 23 and 24 of the movable connector 70M are inserted into the slide grooves 13 and 14 of the fixed connector 70F, and the movable connector 70M is slid to the fixed connector 70F. During the sliding, the lock protrusions 75A and 75B on the arms 72A and 72B of the movable connector 70M move on the guiding paths 76A and 76B along the guiding walls 78.

Figure 13D:
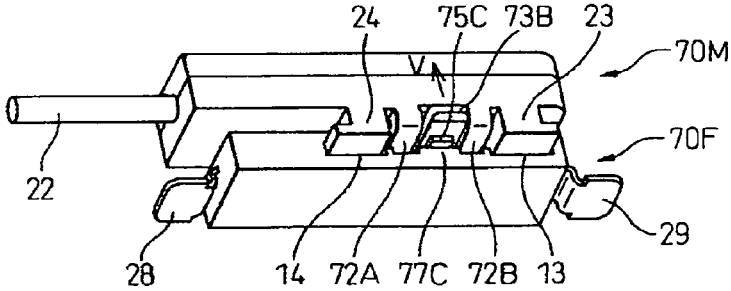
FIG. 13D is a perspective view showing an operation of a lock mechanism when a lock protrusion of the movable connector touches a lock wall of the fixed connector.

The movable connector 70M slides to the fixed connector 70F until the lock protrusion 75C on the arm 72C of the movable connector 70M touches the lock wall 77C of the fixed connector 70F, as illustrated in FIG. 13D. Further sliding of the movable connector 70M forces the lock wall 77C to slide on the sloped surface of the lock protrusion 75C, because the surface of the lock protrusion 75C slopes toward the base of the arm 72C, and thus the arm 72C bends in a direction V.

When edges of the lock protrusions 75A and 75B of the movable connector 70M touch the lock walls 77A and 77B of the fixed connector 70F, the lock protrusion 75C slides over the lock wall 77C, and the bent arm 72C returns to its original state. At this time, the vertically-standing surface of the lock protrusion 75C engages with the lock wall 77C. As a result, the movable connector 70M is locked to the fixed connector 70F. This state is the same as the state already described and illustrated in FIGS. 14A to 14E. The slide, to the fixed connector 70F, of the movable connector 70M from either of the longer sides results in the same joined state.

In order to remove the joined movable connector 70M from the fixed connector 70F, the unlocking tab 73B is pushed up in a direction K illustrated in FIG. 14D to disengage the lock protrusion 75C from the lock wall 77C. After the disengagement, the movable connector 70M is slid in a direction X from the fixed connector 70F and removed from the fixed connector 70F. Contrarily, the unlocking tab 73A is pushed up in a direction L illustrated in FIG. 14D to disengage the lock protrusion 75A from the lock wall 77A (and to disengage the lock protrusion 75B from the lock wall 77B) illustrated in FIG. 14E. After the disengagement, the movable connector 70M is slid in a direction Y from the fixed connector 70F and removed from the fixed connector 70F.

The connector system 70, according to the third embodiment, including the movable connector 70M able to be joined to the fixed connector 70F from either of the two longer sides, was described above. According to this embodiment, the lock mechanism 71 of the movable connector 70M includes the three arms 72A, 72B, and 72C having the lock protrusions 75A, 75B, and 75C, and the lock mechanism 76 of the fixed connector 70F includes the lock walls 77A, 77B, and 77C. Contrarily, the lock mechanism 71 of the movable connector 70M may include the lock walls 77A, 77B, and 77C, and the lock mechanism 76 of the fixed connector 70F may include the three arms 72A, 72B, and 72C having the lock protrusions 75A, 75B, and 75C.

According to the third embodiment, the lock mechanism 71 includes the three arms and the lock protrusions on the leading ends of the arms. However, a modification having two arms is realizable. A modification having two arms is described with reference to FIGS. 15A to 15C.

Figure 15A:
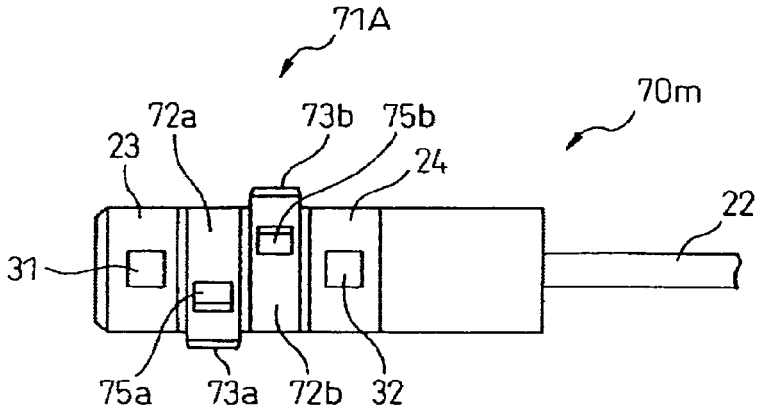
FIG. 15A is a bottom view showing a structure of a modification of the third embodiment of the movable connector.
Figure 15B:
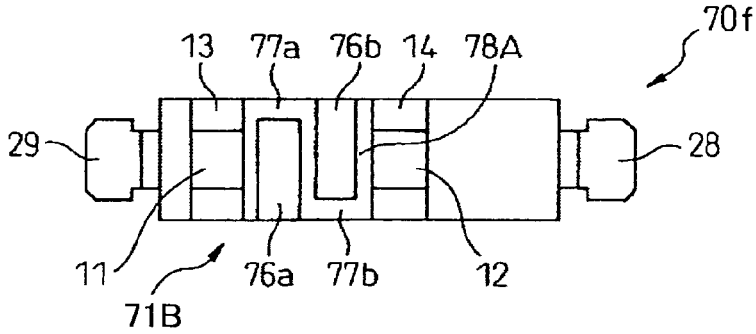
FIG. 15B is a plan view of a fixed connector to which the movable connector illustrated in FIG. 15A is joined.
Figure 15C:
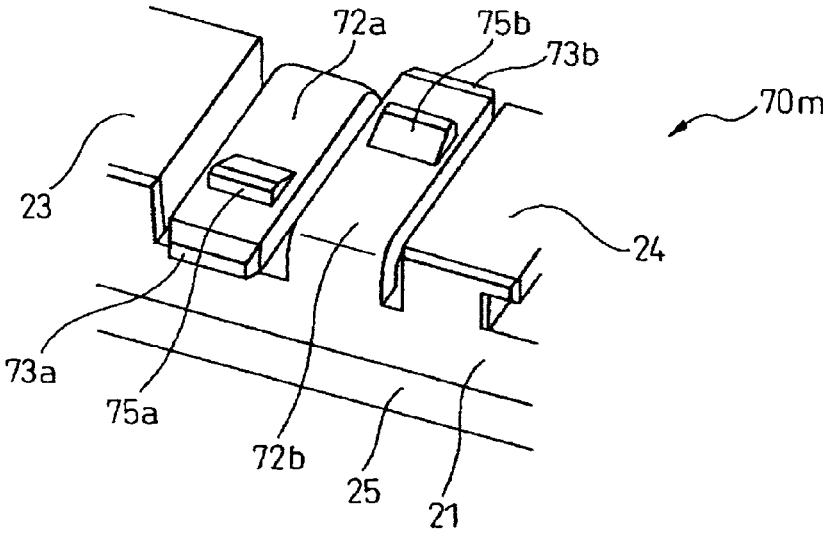
FIG. 15C is an enlarged partial perspective view of arms of the movable connector illustrated in FIG. 15A.

FIG. 15A shows a structure of a movable connector 70*m* of a modification of the third embodiment of the invention, and FIG. 15B shows a fixed connector 70*f* for being joined with the movable connector 70*m* illustrated in FIG. 15A. FIG. 15C shows arms 72*a* and 72*b* of the movable connector 70*m* in close-up. This modification is different from the third embodiment only in terms of structures of the lock mechanism 71A of the movable connector 70*m* and the lock mechanism 71B of the fixed connector 70*f*. Therefore, the same elements in the third embodiment are given the same reference numerals and their explanations are omitted, and the structures of the lock mechanisms 71A and 71B are described hereinafter.

The lock mechanism 71A includes two arms 72*a* and 72*b*. Like the third embodiment, top surfaces of the two arms 72*a* and 72*b* are not the same in height as ones of the slide protrusions 23 and 24. The arm 72*a* is located at a predetermined distance from the arm 72*b*. The arm 72*a* stands from one end portion of a bottom surface of the bottom case 21, and the arm 72*b* stands on an opposite end portion of the bottom surface of the bottom case 21. In other words, the arms 72*a* and 72*b* stand on side surfaces opposite to each other of the bottom case 21. The two arms 72*a* and 72*b* bend to be parallel with and above the bottom surface of the bottom case 21, and the leading ends of the two arms are extended beyond sides of the bottom case 21 and serve as unlocking tabs 73*a* and 73*b* respectively.

Lock protrusions 75*a* and 75*b* are respectively placed near the leading ends of the arms 72*a* and 72*b*. The lock protrusions 75*a* and 75*b* have: surfaces standing vertically to the arms 72*a* and 72*b*, respectively facing to the leading ends of the arms 72*a* and 72*b*; and surfaces sloping toward the bases of the arms 72*a* and 72*b*. The leading ends of the arms 72*a* and 72*b* can be bent by pushing down the unlocking tabs 73*a* and 73*b* of the lock mechanism 71A, similarly to the ones according to the third embodiment.

FIG. 15B shows a structure of a lock mechanism 71B of the fixed connector 70*f* for being joined with the movable connector 70*m* illustrated in FIG. 15A. The lock mechanism 71B includes two guiding paths 76*a* and 76*b*, lock walls 77*a* and 77*b*, and a guiding wall 78A. The guiding wall 78 includes three parts located evenly spaced apart in parallel on a shorter side of the fixed connector 70*f*. The guiding wall 78 is as high as the guiding walls according to the third embodiment. Two guiding paths 76*a* and 76*b* are spaces between two parts of the guiding wall 78. The lock walls 77*a* and 77*b*, continuing into the guiding walls 78A, are respectively located at ends of the guiding paths 76*a* and 76*b*. The lock wall 77*a* is not located on the same shorter side where the lock wall 77*b* is located, but is located the opposite side in the fixed connector 70*f*.

As the movable connector 70*m* and the fixed connector 70*f* respectively having the lock mechanisms 71A and 76A configured as described above are joined and disengaged in the same operations as the ones described in the third embodiment, further explanation is omitted.

4. Fourth Embodiment

Figure 16A:
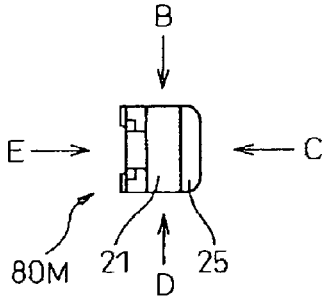
FIG. 16A is a front view showing a structure of a movable connector of a fourth embodiment.
Figure 16B:
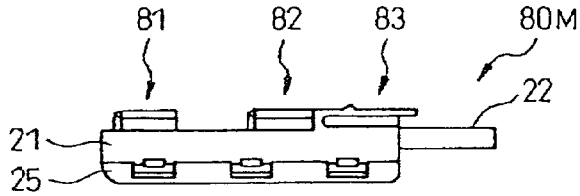
FIG. 16B is a side view of the connector illustrated in FIG. 16A, viewed from a direction B.
Figure 16C:
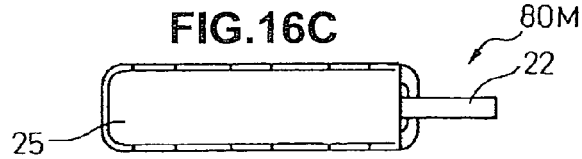
FIG. 16C is a side view of the connector illustrated in FIG. 16A, viewed from a direction C.
Figure 16D:
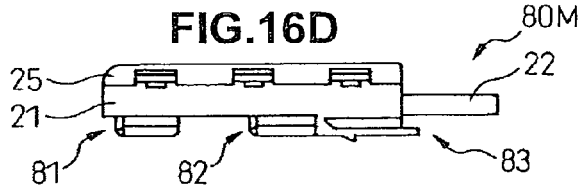
FIG. 16D is a side view of the connector illustrated in FIG. 16A, viewed from a direction D.
Figure 16E:
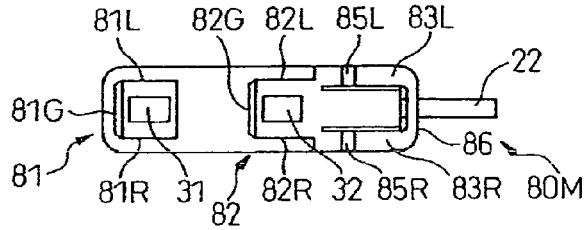
FIG. 16E is a side view of the connector illustrated in FIG. 16A, viewed from a direction E.
Figure 16F:
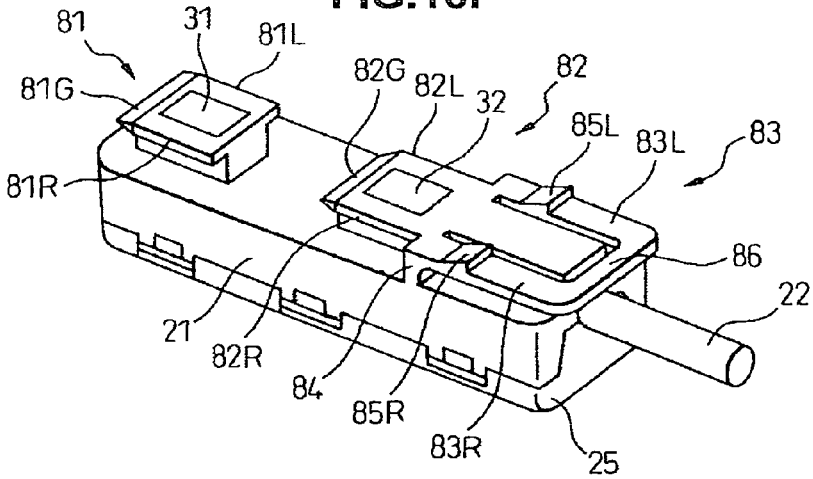
FIG. 16F is a perspective view of the movable connector according to the fourth embodiment, viewed from the backside.

FIGS. 16A to 16F show a structure of a movable connector 80M of a connector system having movable and fixed connectors, of a fourth embodiment of the invention. FIG. 16A shows a front view of the movable connector 80M. FIGS. 16B to 16E show side views of the movable connector 80M respectively viewed from the directions B, C, D, and E illustrated in FIG. 16A. FIG. 16F shows a bottom view of the movable connector 80M according to the fourth embodiment. For the fourth embodiment, elements same as the ones according to the first embodiment are given the same reference numerals and their explanations are omitted.

The movable connector 80M is the same as the one according to the first embodiment in terms of structures of a bottom case 21 and a top case 25, a circuit board in the bottom case 21, a cable 22 for connecting to the movable connector 80M. In this embodiment, a side where the cable 22 is not connected is referred to as the front side, and a side where the cable 22 is connected is referred to as the rear side. On a lower surface of the bottom case 21, a first slide protrusion 81 is located on the front side and a second slide protrusion 82 is located on the rear side at a predetermined distance from the first slide protrusion 81 along a longer side of the bottom case 21. A lock mechanism 83 is located on the rear side of the second slide protrusion 82.

The first slide protrusion 81 is a cuboid, and has, on its two upper sides, stopper protrusions 81L and 81R extended toward directions parallel with longer sides (a direction in which the movable connector 80M is joined or removed) of the bottom case 21. The stopper protrusion 81L shares a top surface with the first slide protrusion 81 and the stopper protrusion 81R. The first slide protrusion 81 has a guiding protrusion 81G, on the front side of the first slide protrusion 81, for allowing smooth insertion of the stopper protrusions 81L and 81R into stopper grooves of a fixed connector described later. The stopper protrusions 81L and 81R have a locking function for preventing the movable connector 80M from disengaging from the fixed connector described later when the movable connector 80M is joined with the fixed connector. An uncovered connecting terminal 31 is located on the top surface of the first slide protrusion 81.

The second slide protrusion 82 is similar in shape to the first slide protrusion 81, and has stopper protrusions 82L and 82R on its two upper sides. The stopper protrusion 82L shares a top surface with the second slide protrusion 82 and the stopper protrusion 82R, and has a guiding protrusion 82G on the front side of the second slide protrusion 82, like the first slide protrusion 81. The stopper protrusions 82L and 82R have a locking function for preventing the movable connector 80M from disengaging from the fixed connector described later when the movable connector 80M is joined with the fixed connector. An uncovered connecting terminal 32 is located on the top surface of the second slide protrusion 82.

The second slide protrusion 82 has, on an end face of the rear side, a stopper wall 84 for halting the movable connector 80M from sliding, and the lock mechanism 83 is installed in the stopper wall 84. The lock mechanism 83 includes two arms 83L and 83R, and lock protrusions 85L and 85R. The two arms 83L and 83R stand on the front side of the stopper wall 84, then bend to be extended in parallel with the bottom surface of the bottom case 21. As a result, the leading ends of the two arms 83L and 83R can bend to and against their bases. The leading ends of the two arms 83L and 83R are joined beyond the rear end of the bottom case 21 and serve as an unlocking tab 86. The lock protrusions 85L and 85R slope toward the front sides thereof and stand vertically to the arms 83L and 83R on the rear sides thereof.

Figure 17A:
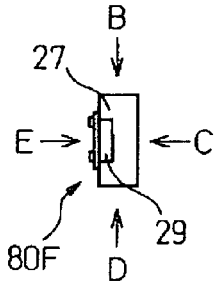
FIG. 17A is a front view showing a structure of a fixed connector according to the fourth embodiment.
Figure 17B:
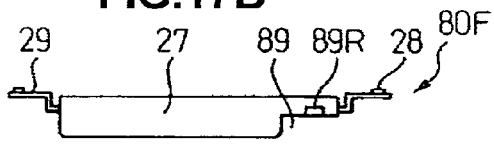
FIG. 17B is a side view of the connector illustrated in FIG. 17A, viewed from a direction B.
Figure 17C:
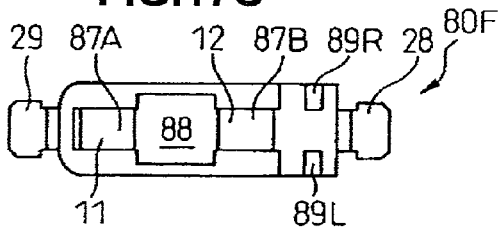
FIG. 17C is a side view of the connector illustrated in FIG. 17A, viewed from a direction C.
Figure 17F:
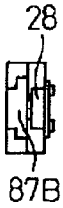
FIG. 17F is a back view of the fixed connector.
Figure 17D:
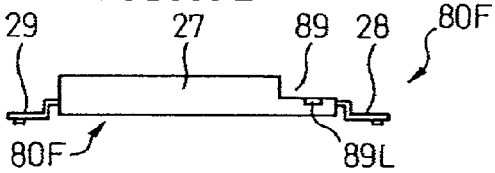
FIG. 17D is a side view of the connector illustrated in FIG. 17A, viewed from a direction D.
Figure 17E:
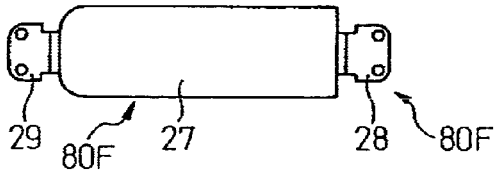
FIG. 17E is a side view of the connector illustrated in FIG. 17A, viewed from a direction E.

FIGS. 17A to 17G show a structure of a fixed connector 80F according to the fourth embodiment of the invention. FIG. 17A shows a front view of the fixed connector 80F. FIGS. 17B to 17E show side views of the fixed connector 80F respectively viewed from the directions B, C, D, and E. FIG.

Figure 17G:
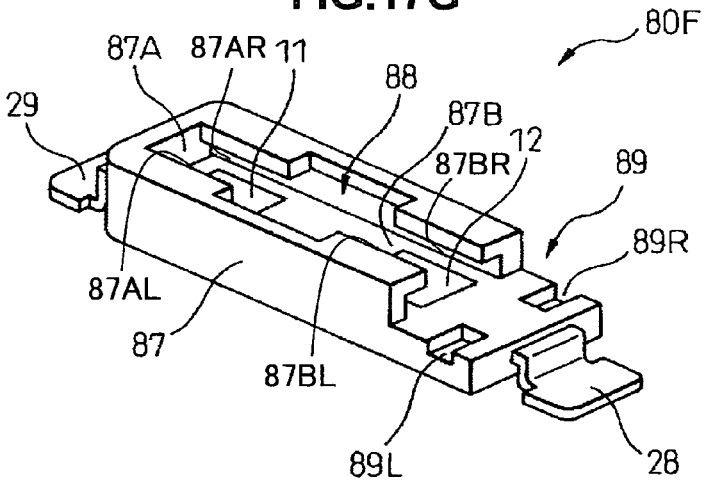
FIG. 17G is a perspective view of the fixed connector according to the fourth embodiment, viewed from a surface.

17F is a back view of the fixed connector 80F, and FIG. 17G is a top perspective view of the fixed connector 80F viewed from above.

The fixed connector 80F includes a base 87, and legs 28 and 29 attached to the base 87. A side where the leg 28 is attached, hereinafter, is referred to as the rear side, and a side where the leg 29 is attached is referred to as the front side. The base 87 has a guide hole 88 for accommodating the aforementioned first slide protrusion 81 and a stepped section 89 on a side to which the movable connector 80M is joined. The guide hole 88 has a shape allowing insertion of the first slide protrusion 81 of the movable connector 80M. The stepped section 89 is formed by cutting out a portion of the rear side of the base 87 in parallel with the top surface of the base 87.

The base 87 has, on the front side, a slide groove 87A leading to the guide hole 88, for accommodating the first slide protrusion 81 of the movable connector 80M. Therefore, when taken along the width of the body 87, a cross-sectional shape of the slide groove 87A is slightly bigger than the one of the first slide protrusion 81. Stopper grooves 87AL and 87AR are concavities located on side surfaces of the slide groove 87A, for accommodating the stopper protrusions 81L and 81R on the first slide protrusion 81. An uncovered electrode 11 is located, for electrically connecting to the leg 29, on the bottom surface of the slide groove 87A.

A slide groove 87B leading to the stepped section 89 is located in an adjacent area to the stepped section 89 of the base 87, for accommodating the second slide protrusion 82 of the movable connector 80M. Therefore, when taken along the width of the body 87, a cross-sectional shape of the slide groove 87B is slightly bigger than the one of the second slide protrusion 82. Stopper grooves 87BL and 87BR are concavities located on side surfaces of the slide groove 87B, for accommodating the stopper protrusions 82L and 82R on the second slide protrusion 82. An uncovered electrode 12 is located, for electrically connecting to the leg 28, on the bottom surface of the slide groove 87B.

The lock grooves 89L and 89R are located on two sides of the top surface of the stepped section 89, for accommodating the lock protrusions 85L and 85R protruding from the arms 83L and 83R of the lock mechanism 83 of the movable connector 80M. Depth of the stepped section 89 is the same as height of the stopper wall 84 of the movable connector 80M.

Figure 18A:
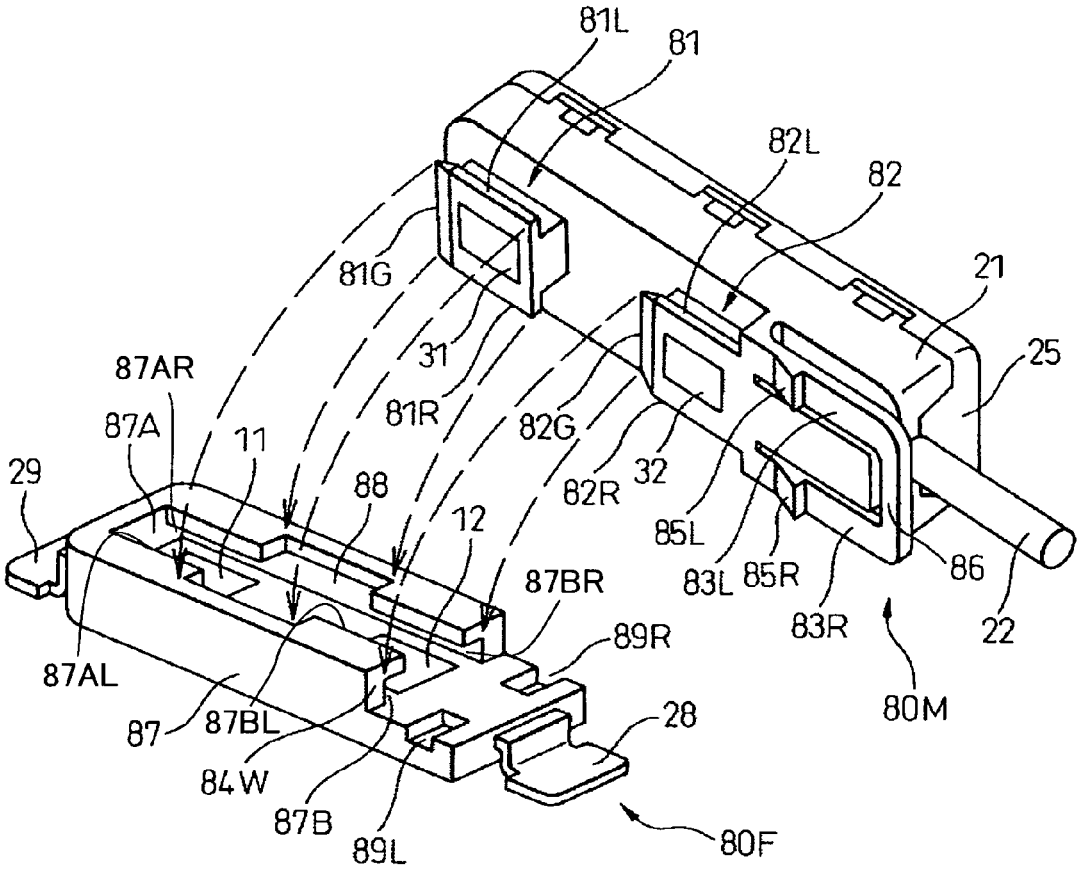
FIG. 18A is an exploded perspective view showing a state where the movable connector according to the fourth embodiment is joined to the fixed connector.
Figure 18B:
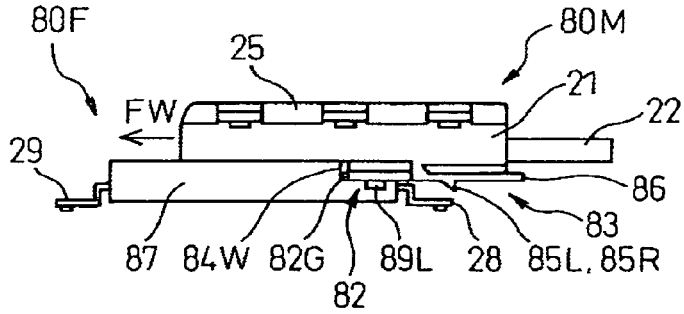
FIG. 18B is a side view showing the movable connector fitted in the fixed connector just before being slid.

FIG. 18A shows the movable connector 80M, illustrated in FIGS. 16A to 16F, just before being joined to the fixed connector 80F illustrated FIGS. 17A to 17G. FIG. 18B shows the movable connector 80M after being engaged with the fixed connector 80F and just before being slid. The fixed connector 80F is preliminarily fixed on a certain mounting surface, i.e., a fixed glass plate of a vehicle provided with an antenna, with the legs 28 and 29 being connected to the antenna by soldering or another method.

In order to connect the movable connector 80M to the fixed connector 80F, as illustrated in FIG. 18A, the first slide protrusion 81 of the movable connector 80M is inserted into the guide hole 88 of the fixed connector 80F that is fixed. At the same time, the second slide protrusion 82 is located on the stepped section 89. FIG. 18B shows this state. In this state, the guiding protrusion 81G of the first slide protrusion 81 and the guiding protrusion 82G of the second slide protrusion 82 of the movable connector 80M respectively face the slide groove 87A and the slide groove 87B of the fixed connector 80F.

When the movable connector 80M in the state illustrated in 18B slides in a direction FW, the first slide protrusion 81 is accommodated into the slide groove 87A, and the second slide protrusion 82 is accommodated into the slide groove 87B. The slide of the movable connector 80M ends when the stopper wall 84 touches a wall 84W of the stepped section 89. At the time, the lock protrusions 85L and 85R of the lock mechanism 83 respectively engage with the lock grooves 89L and 89R. FIGS. 19A to 19F show this state.

Figure 19A:
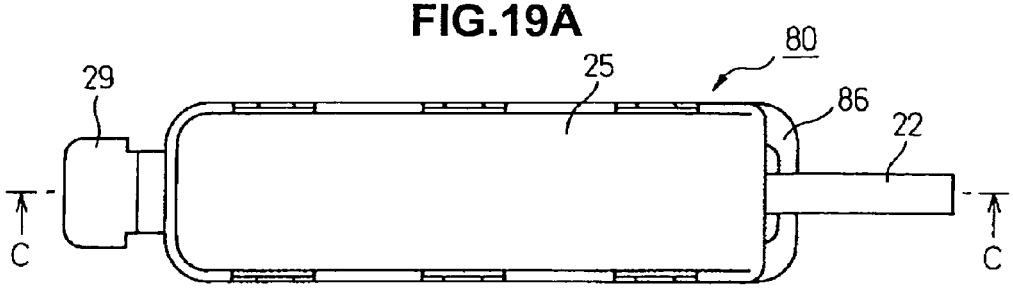
FIG. 19A is a plan view showing joining of the movable connector according to the fourth embodiment to the fixed connector.
Figure 19B:
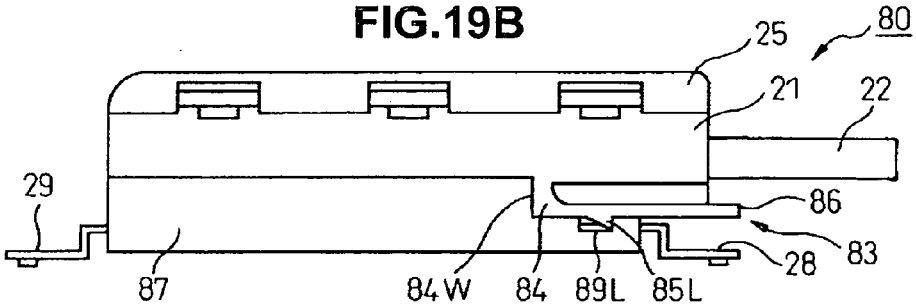
FIG. 19B is a side view of the connector system illustrated in FIG. 19A.

FIG. 19A is a top view of the connector system 80 with the movable connector 80M joined with the fixed connector 80F. FIG. 19B is a side view of the connector system 80 illustrated in FIG. 19A, showing the stopper wall 84 touching the wall 84W of the stepped section 89 and the lock protrusions 85L engaging with the lock groove 89L. Like the aforementioned embodiments, in order to remove the joined movable connector 80M from the fixed connector 80F, the unlocking tab 86 is pushed up to disengage the lock protrusion 85L and the lock protrusion 85R not illustrated from the lock grooves 89L and the lock groove 89R not illustrated.

Figure 19C:
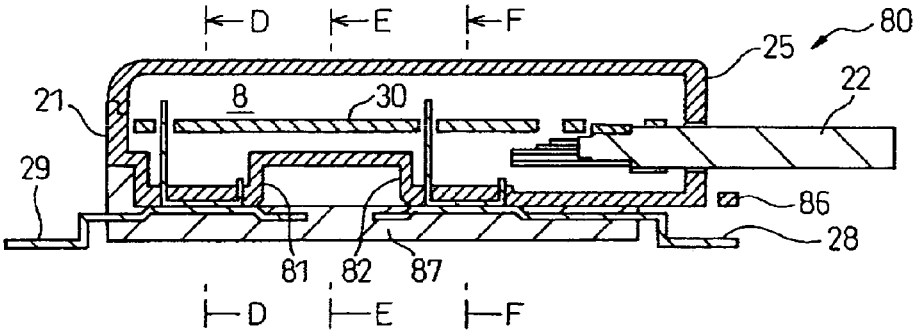
FIG. 19C is a partial sectional view of the connector system illustrated in FIG. 19A, taken along the line C to C.
Figure 19D:
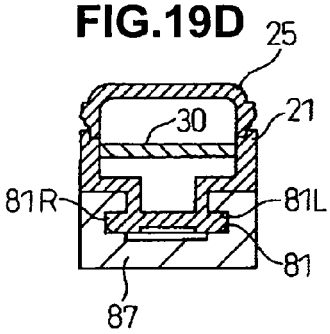
FIG. 19D is a partial sectional view of the connector system illustrated in FIG. 19A, taken along the line D to D.
Figure 19E:
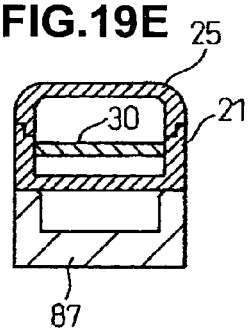
FIG. 19E is a partial sectional view of the connector system illustrated in FIG. 19A, taken along the line E-E.
Figure 19F:
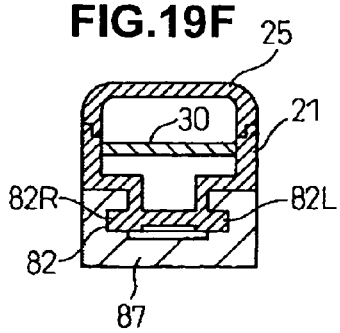
FIG. 19F is a partial sectional view of the connector system illustrated in FIG. 19A, taken along the line F-F.

FIG. 19C is a partial sectional view taken along the line C-C in FIG. 19A. FIGS. 19D, 19E, and 19F are partial sectional views of the connector system 80 illustrated in FIG. 19C respectively taken along the lines D-D, E-E, and F-F. When the movable connector 80M is joined to the fixed connector 80F, the movable connector 80M cannot be removed from the fixed connector 80F upward because the stopper protrusions 81L and 81R of the first slide protrusion 81 engage with the stopper grooves 87AL and 87AR of the fixed connector 80F, and the stopper protrusions 82L and 82R of the second slide protrusion 82 engage with the stopper grooves 87BL and 87BR of the fixed connector 80F.

For the connector system 80 according to the fourth embodiment, the movable connector 80M is fitted in the fixed connector 80F from the above of the fixed connector 80F and is slid toward the front end of the fixed connector 80F to join with the fixed connector 80F. Locating the first slide protrusion 81 and the second slide protrusion 82 at a predetermined distance from each other can limit the slide of the movable connector 80M toward the fixed connector 80F. As a result, a space for the fitting can be reduced. Joining the movable connector 80M with the fixed connector 80F at two points of the first and second slide protrusions 81 and 82 reduces probability of disengagement between the movable connector 80M and the fixed connector 80F and eliminates wobble at the time of joining.

According to the fourth embodiment, the first slide protrusion 81 and the second slide protrusion 82 are located on the movable connector 80M, and the slide grooves 87A and 87B are located on the base 87 of the fixed connector 80F. However, slide grooves may be located on the movable connector 80M, and slide protrusions may be located on the base 87 of the fixed connector 80F. Similarly, lock protrusions and lock grooves of the lock mechanism 83 may be located respectively on the fixed connector 80F and the movable connector 80M, reversely to the above-described structure.

While the invention has been shown and described in detail, the foregoing description is in all aspects illustrative and not restrictive. It is therefore understood that numerous other modifications and variations can be devised without departing from the scope of the invention.

What is claimed is:

1. A connector system for a vehicle antenna, the system comprising:

a first connector that is electrically connectable to a terminal of the vehicle antenna; and a second connector that is electrically connectable to a cable for transmittance of received signals received by the vehicle antenna to a signal receiving apparatus that uses the received signals, the second connector being attachable to and removable from the first connector and being electrically connected to the first connector when attached to the first connector, the first connector including: legs for touching a mounting surface of the first connector so as to be electrically connected to the terminal of the vehicle antenna; a first slide mechanism having a first sliding surface extending substantially parallel to the mounting surface; and a body to which the legs and the first slide mechanism are provided, the body having a length extending in a first direction parallel to the mounting surface, and a width extending in a second direction perpendicular to the first direction and parallel to the mounting surface, the length being larger than the width, and the second connector including a second slide mechanism having a second sliding surface that is mateable with the first sliding surface, the second sliding surface extending substantially parallel to the mounting surface when mated with the first sliding surface; a body to which the second slide mechanism is provided, the body of the second connector having a length extending in the first direction parallel to the mounting surface, and a width extending in the second direction perpendicular to the first direction and parallel to the mounting surface, the length of the second connector being larger than the width of the second connector; and a cable extending in the first direction from the body of the second connector, wherein the first and second connectors are configured such that the second connector is moved in a direction parallel to the mounting surface so that the first and second sliding surfaces slide relative to each other in the direction parallel to the mounting surface to mate the second sliding surface to the first sliding surface and thereby mate the second connector to the first connector.

2. The connector system for a vehicle antenna according to claim 1, wherein the first slide mechanism is a first one of a slide protrusion and a slide groove; and the second slide mechanism is a second one of the slide protrusion and the slide groove.

3. The connector system for a vehicle antenna according to claim 1, wherein the first slide mechanism is located on a surface of the first connector that faces away from the mounting surface.

4. The connector system for a vehicle antenna according to claim 1, wherein the first and second connectors are configured such that the connector is moved in the second direction so that the first and second sliding surfaces slide relative to each other in the second direction to mate the second sliding surface to the first sliding surface.

5. The connector system for a vehicle antenna according to claim 1, wherein the first slide mechanism and the second slide mechanism each include stopper mechanisms that are engageable with each other for preventing relative movement of the first and second connectors in a direction perpendicular to a sliding direction by which the first and second connectors slide so as to be mated with each other.

6. The connector system for a vehicle antenna according to claim 5, wherein the stopper mechanism of the first slide mechanism is a tapered side surface in the sliding direction, and the stopper mechanism of the second slide mechanism is a reverse-tapered side surface facing the tapered side surface.

7. The connector system for a vehicle antenna according to claim 5, wherein the stopper mechanism of the first slide mechanism is a first one of a protrusion located on a side surface in the sliding direction and a concavity for accommodating the protrusion, and the stopper mechanism of the second slide mechanism is a second one of the protrusion and the concavity.

8. The connector system for a vehicle antenna according to claim 1, wherein the first connector includes an electrode electrically connected to the leg and disposed on a side of the first connector facing the second slide mechanism when the first connector is joined with the second connector, and the second slide mechanism includes a connecting terminal that contacts the electrode when the first connector is joined with the second connector.

9. The connector system for a vehicle antenna according to claim 1, wherein the second connector includes a circuit that processes the received signals received by the vehicle antenna.

10. A connector system for a vehicle antenna, the system comprising:

a first connector that is electrically connectable to a terminal of the vehicle antenna;

a second connector that is electrically connectable to a cable for transmittance of received signals received by the vehicle antenna to a signal receiving apparatus that uses the received signals, the second connector being attachable to and removable from the first connector and being electrically connected to the first connector when attached to the first connector, the first connector including: legs for touching a mounting surface of the first connector so as to be electrically connected to the terminal of the vehicle antenna; and a first slide mechanism extending substantially parallel to the mounting surface, the second connector including a second slide mechanism for sliding along an extending direction of the first slide mechanism and being mateable with the first slide mechanism; and a circuit that processes the received signals received by the vehicle antenna; and a removable connector for connecting and disconnecting the cable to and from an output terminal of the circuit in the second connector.

11. The connector system for a vehicle antenna according to claim 10, wherein the removable connector includes a female connector connected to the cable, and which is attachable to and removable from a male connector connected to the output terminal.

12. The connector system for a vehicle antenna according to claim 1, wherein the first connector and the second connector each include:

lock mechanisms for engaging with each other to hold the first connector and the second connector joined to each other when the first and second slide mechanisms are completely mated with each other.

13. The connector system for a vehicle antenna according to the claim 12, wherein the lock mechanism of the first connector is a first one of a lock wall and a bendable arm having a lock protrusion engageable with the lock wall near a leading end of the arm, the lock mechanism of the second connector is a second one of the lock wall and the bendable arm, and the lock protrusion on the bendable arm:

touches the lock wall when the second connector is slid into engagement with the first connector; and slides over and engages with the lock wall by further sliding of the second connector relative to the first connector, bending the bendable arm after the lock protrusion touches the lock wall.

14. The connector system for a vehicle antenna according to claim 13, further comprising:

at least two sets of the lock walls and the bendable arms, wherein a base of one of the bendable arms stands from one of two side surfaces of the second connector, an other one of the bendable arms stands from the other side surface of the second connector, and the second connector is attachable to the first connector from either side surface of the first connector.

15. The connector system for a vehicle antenna according to claim 13, further comprising:

at least two sets of the lock walls and the bendable arms, wherein a base of one of the bendable arms stands from one of two side surfaces of the first connector, an other one of the bendable arms stands from the other side surface of the first connector, and the second connector is attachable to the first connector from the either side surface of the first connector.

16. The connector system for a vehicle antenna according to claim 1, wherein the first connector includes a guide hole in an upper surface thereof which faces away from the mounting surface, the second connector includes a slide protrusion that protrudes from a lower surface thereof which faces the first connector, the slide protrusion sized to fit within the guide hole of the first connector, and the first and second connectors are configured such that the second connector is moved in the first direction so that the first and second sliding surfaces slide relative to each other in the first direction to mate the second sliding surface to the first sliding surface after the slide protrusion of the second connector is inserted into the guide hole of the first connector.

* * * * *